US007448733B2

(12) United States Patent
Murata et al.

(10) Patent No.: US 7,448,733 B2
(45) Date of Patent: Nov. 11, 2008

(54) LIQUID DROPLET EJECTING HEAD AND LIQUID DROPLET EJECTING DEVICE

(75) Inventors: Michiaki Murata, Ebina (JP); Yoshinao Kondoh, Ebina (JP); Hiroyuki Usami, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 442 days.

(21) Appl. No.: 11/220,013

(22) Filed: Sep. 6, 2005

(65) Prior Publication Data

US 2006/0203042 A1 Sep. 14, 2006

(30) Foreign Application Priority Data

Mar. 8, 2005 (JP) ..... 2005-064474

(51) Int. Cl.
*B41J 2/045* (2006.01)

(52) U.S. Cl. ..... 347/71

(58) Field of Classification Search ..... 347/68, 347/70–72

See application file for complete search history.

(56) References Cited

U.S. PATENT DOCUMENTS 5,757,400 A * 5/1998 Hoisington ..... 347/40
6,382,781 B2 * 5/2002 Furuhata et al. ..... 347/68
6,808,254 B2 * 10/2004 Sakaida et al. ..... 347/71
6,986,565 B2 * 1/2006 Watanabe et al. ..... 347/71

FOREIGN PATENT DOCUMENTS

JP 2-301445 12/1990
JP 9-323414 12/1997
JP 2005-103861 4/2005

* cited by examiner

*Primary Examiner*—An H Do
(74) *Attorney, Agent, or Firm*—Fildes & Outland, P.C.

(57) ABSTRACT

A liquid droplet ejecting head including a piezoelectric element substrate including a diaphragm and a piezoelectric element; a liquid pool chamber that pools liquid supplied to a pressure chamber and which is provided opposite a pressure chamber filled with liquid with the piezoelectric element substrate placed in between; an upper substrate arranged so as to separate the liquid pool chamber and the piezoelectric element substrate with the piezoelectric element substrate between with a through port for supplying liquid to the pressure chamber from the liquid pool chamber formed therein; a driver that is mounted on the upper substrate and which drives the piezoelectric element; a connecting component arranged between the opposite upper substrate and the piezoelectric element substrate and which electrically connects this upper substrate to the piezoelectric element.

19 Claims, 32 Drawing Sheets

LIQUID DROPLET EJECTING HEAD AND LIQUID DROPLET EJECTING DEVICE

CROSS-REFERENCE TO RELATED APPLICATIONS

This application claims priority under 35 USC 119 from Japanese Patent Application No. 2005-64474, the disclosure of which is incorporated by reference herein.

BACKGROUND OF THE INVENTION

1. Field of the Invention

The present invention relates to a liquid droplet ejecting head having nozzles that eject droplets, pressure chambers that are communicated with the nozzles and are filled with a liquid, a diaphragm that comprises a portion of the pressure chambers, a liquid pool chamber that pools liquid supplied through liquid channels to the pressure chambers, and piezoelectric elements that displace the diaphragm. The present invention also relates to a liquid droplet ejecting device equipped with this liquid droplet ejecting head.

2. Description of the Related Art

Conventionally, inkjet recording devices are known in which ink droplets are selectively ejected from multiple nozzles of an inkjet recording head (hereafter, there are cases where this is simply referred to as "recording head") which acts as a liquid droplet ejecting device. Such devices print text and images on a recording medium such as recording paper.

In these inkjet recording devices, various systems are used in the recording head such as piezoelectric systems and thermal systems. In, for example, the case of a piezoelectric system, a piezoelectric element 206 (i.e., an actuator that converts electric energy into mechanical energy) is provided in a pressure chamber 204 to which ink 200 is supplied through an ink pool chamber 202 from an ink tank (refer to FIGS. 24 and 25). The piezoelectric element 206 is configured so as to flex deform in a concave shape and make the volume of the pressure chamber 204 decrease and pressurize the ink 200 inside, thereby making the ink eject as an ink droplet 200A from a nozzle 208 communicated with the pressure chamber 204.

With inkjet recording heads of this kind of configuration, there has been a demand in recent years for recording heads that can provide high-resolution printing while maintaining compactness and low cost. In order to answer this need, it is necessary to set the nozzles such as to provide a highly dense arrangement. Nonetheless, as shown in the drawings, current recording heads have the ink pool chamber 202 provided next to the nozzles 208 (i.e., between each of the nozzles 208) so there has also been a limit to the degree to which the nozzles 208 can be arranged in highly dense formations.

Moreover, a drive IC that applies voltage to predetermined piezoelectric elements is provided in the inkjet recording head. As shown in FIG. 26, this is conventionally mounted with a flexible print circuit (FPC) 210. That is, bumps 212 formed at the FPC 210 are joined to the metallic electrode surface of the upper surface of the piezoelectric element 206 provided on a diaphragm 214. At this stage, the piezoelectric element 206 and the drive IC (not shown) are electrically connected since the drive IC is mounted on this FPC 210.

Further, there are methods where an electrode terminal on a mounting substrate on which the IC drive is mounted and an electrode terminal provided on the exterior surface of the recording head are connected with a wire-bonding method (see, for example, the Official Gazette of Japanese Patent Application Laid-Open (JP-A) No. 2-301445). Furthermore, there are systems where after joining and connecting a drive IC to an electrode terminal provided on the exterior surface of the recording head, an FPC is joined and connected to an electrode terminal of pullout wiring provided on the recording head (see, for example, the Official Gazette of JP-A No. 9-323414).

Nevertheless, in both of these cases, when the nozzles are set in a highly dense arrangement, the sizes of the mounting substrate and FPC increase since wiring of a minute pitch (e.g., a pitch of 10 μm or less) cannot be formed. This causes problems such as inhibiting the compactness of the device and increasing the cost. Further, when the density of the nozzles arrangement becomes high, wiring having the desired resistance value cannot be drawn out, so there have been limitations to how densely the nozzles can be arranged due to limitations on the wiring density.

SUMMARY OF THE INVENTION

In light of these problems, the present invention was made to provide a liquid droplet ejecting head that can realize a dense arrangement of nozzles and the formation of minute pitch wiring that accompanies it in order to achieve high resolution; also, to present a compact liquid droplet ejecting head and a liquid droplet ejecting device comprising this liquid droplet ejecting head.

The liquid droplet ejecting head of the present invention comprises: a nozzle that discharges droplets; a pressure chamber communicated with the nozzle and into which a liquid is filled; a piezoelectric element substrate having an diaphragm that forms a part of the pressure chamber and a piezoelectric element that displaces this diaphragm; a liquid pool chamber that is provided at a side opposite the pressure chamber with the piezoelectric element substrate placed in between and which pools liquid supplied to the pressure chamber; an upper substrate arranged so as to separate the liquid pool chamber and the piezoelectric element substrate with the piezoelectric element substrate between with a through port for supplying liquid to the pressure chamber from the liquid pool chamber formed therein; a driver that is mounted on the upper substrate and which drives the piezoelectric element; and a connecting component arranged between the opposite upper substrate and the piezoelectric element substrate and which electrically connects this upper substrate to the piezoelectric element.

With the present invention, a liquid pool chamber is disposed opposite from the pressure chamber with the piezoelectric element substrate being disposed therebetween, so the pressure chambers can be arranged next to each other and the nozzles set at each pressure chamber can be arranged in a highly dense formation.

Further, by disposing the connecting components between the facing piezoelectric element and the upper substrate and electrically connecting them, the driver that drives the piezoelectric element can be mounted on the upper substrate. Accordingly, wiring for the driver and the piezoelectric element can be provided on the upper substrate thus making the wiring simpler. That is, it is not necessary to have the wiring formed on bumps on the substrate, such as is the case when the driver is provided on the piezoelectric element substrate.

Further, the driver, which can become a source of heat, is mounted on the upper substrate so increases in temperature of the liquid in the pressure chambers can be better suppressed than when it is mounted on the piezoelectric element substrate.

Further, the piezoelectric element is electrically connected to the upper substrate that faces each of the connecting components, so the driver is mounted on the piezoelectric element substrate and a large connecting component for connecting to the piezoelectric element of the piezoelectric element substrate becomes unnecessary, whereby the liquid droplet ejecting device can be made more compact.

Further, with the liquid droplet ejecting head of the present invention, the upper substrate is arranged between the liquid pool chamber and the piezoelectric element substrate. For this reason, liquid can be easily kept away from the piezoelectric element without forming a dividing layer. Furthermore, liquid can be easily supplied to each pressure chamber by the formation of through ports in the upper substrate.

The liquid droplet ejecting device has a liquid droplet ejecting head comprising: a nozzle that discharges droplets; a pressure chamber communicated with the nozzle and into which a liquid is filled; a piezoelectric element substrate having an diaphragm that forms a part of the pressure chamber and a piezoelectric element that displaces this diaphragm; a liquid pool chamber that is provided at a side opposite the pressure chamber with the piezoelectric element substrate placed in between and which pools liquid supplied to the pressure chamber; an upper substrate arranged so as to separate the liquid pool chamber and the piezoelectric element substrate with the piezoelectric element substrate between with a through port for supplying liquid to the pressure chamber from the liquid pool chamber formed therein; a driver that is mounted on the upper substrate and which drives the piezoelectric element; a connecting component arranged between the opposite upper substrate and the piezoelectric element substrate and which electrically connects this upper substrate to the piezoelectric element.

Due to the present invention, the nozzles of a liquid droplet ejecting head can be set in a highly dense arrangement so high-resolution image recording is achieved. Further, since the liquid droplet ejecting head can be made to be compact, the liquid droplet ejecting device comprising this liquid droplet ejecting head can also be made to be compact.

DETAILED DESCRIPTION OF THE INVENTION

First Embodiment

Figure 1:
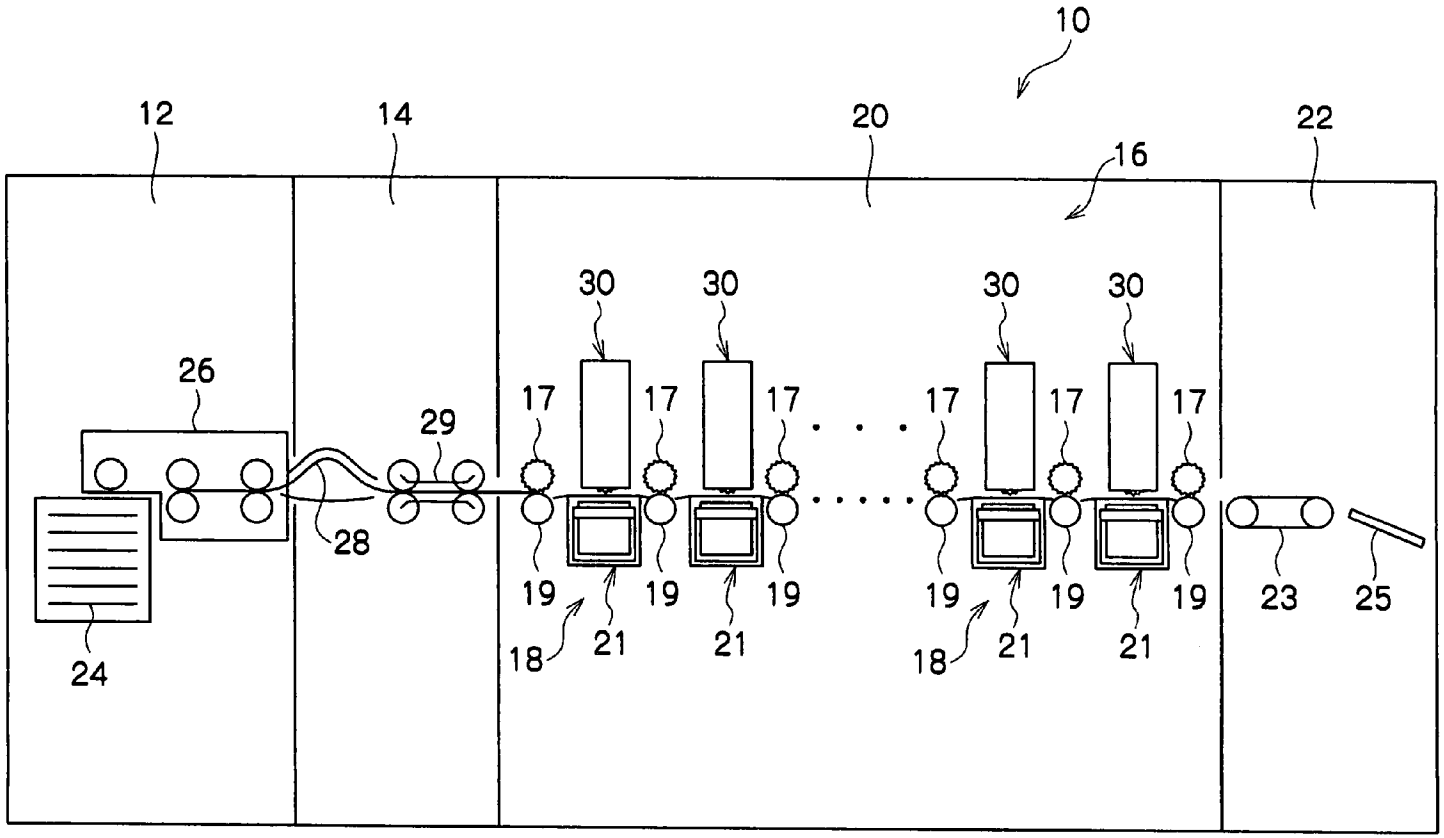
FIG. 1 is a schematic diagram showing the overall structure of the inkjet recording device of the first embodiment.

As shown in FIG. 1, an inkjet recording device 10 basically comprises a paper-supplying unit 12 that sends out paper; an adjustment unit 14 that controls the position of the paper; a recording unit 20 provided with a recording head unit 16 that ejects ink droplets and forms an image on the paper and a maintenance unit 18 that performs maintenance of the recording head unit 16; and an exit unit 22 that ejects the paper on which an image was formed at the recording unit 20.

The paper-supplying unit 12 comprises a stocker 24 in which stacked paper is stocked and a conveying device 26 that feeds paper from the stocker 24 one sheet at a time and conveys it to the adjustment unit 14.

The adjustment unit 14 is provided with a loop-forming unit 28 and a guide component 29 that guides the approach of the paper. By passing through this portion, the body of the paper is used to correct skew, the conveying timing is controlled, and the paper enters the recording unit 20.

The exit unit 22 passes paper on which an image was formed at the recording unit 20 through a paper-exiting belt 23 and stores it on a tray 25.

A paper-conveying route on which recording paper is conveyed is formed between the recording head unit 16 and maintenance unit 18. Recording paper P is continuously sandwiched and held (without stopping) by star wheels 17 and conveying rollers 19. Then ink droplets are ejected from the recording head unit 16 onto this paper and an image is formed on the appropriate recording paper.

The maintenance unit 18 comprises a maintenance device 21 arranged face an inkjet recording head 32, and the maintenance unit 18 can perform processing for the inkjet recording head 32 such as capping and wiping, and even dummy jet and vacuum processing.

Figure 2:
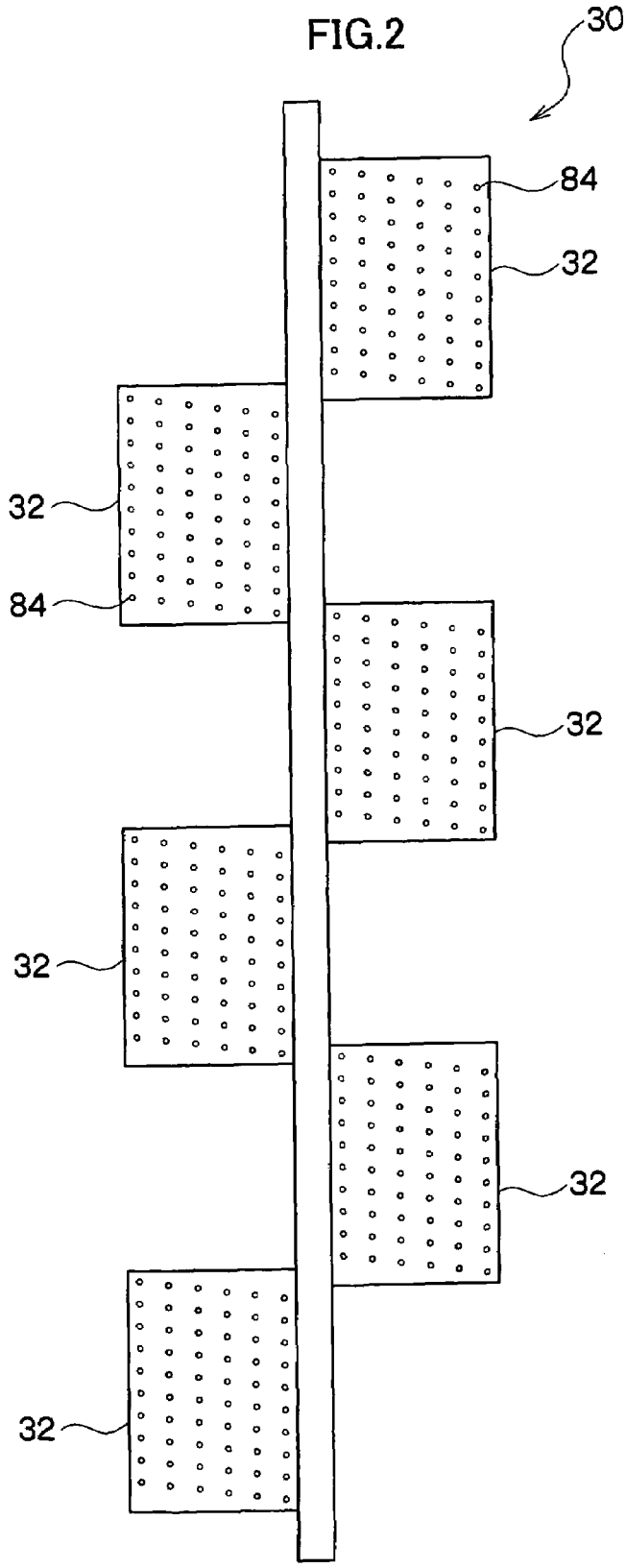
FIG. 2 is a schematic diagram showing the layout of an inkjet recording unit of the first embodiment.

As shown in FIG. 2, each inkjet recording unit 30 is provided with multiple inkjet recording heads 32 arranged in the paper conveying direction and in the direction perpendicular thereto. Multiple nozzles 84 are formed in a matrix pattern in the inkjet recording head 32. An image is recorded on the recording paper by ink droplets being ejected from the nozzles 84 on the recording paper conveyed continuously along the paper-conveying route. It should be noted that the inkjet recording unit 30 has at least four colors arranged therein corresponding to each color of YMCK in order to record, for example, what is known as full-color images.

Figure 3:
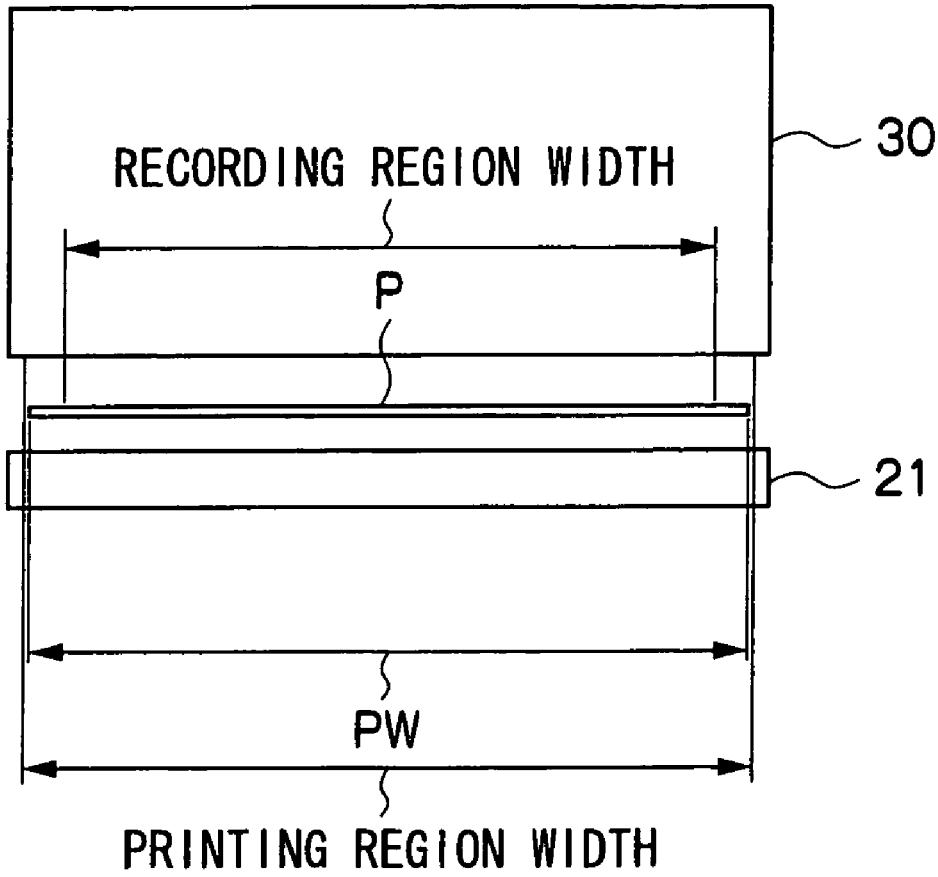
FIG. 3 is a drawing showing the printing region of the inkjet recording unit of the first embodiment.

As shown in FIG. 3, the width of the printing region covered by the nozzles 84 of each of the inkjet recording units 30 is made to be longer than the largest width of the paper PW of the recording paper onto which it is assumed that image recording will be performed with this inkjet recording device 10. Image recording is possible across the entire width of the recording paper without moving the inkjet recording unit 30 in the widthwise directions of the paper (i.e., full width array (FWA) printing). Here, the basis of the printing region are the largest areas inside the recording region from which the margins, which are not printed, from both ends of the paper are excluded, but this is generally larger than the largest paper width PW that is printed. This is due to the fact that there is a danger of the paper inclining from the preset angle relative to the conveying direction (i.e., skewing) and also there is a great demand for no-edge printing.

Figure 4:
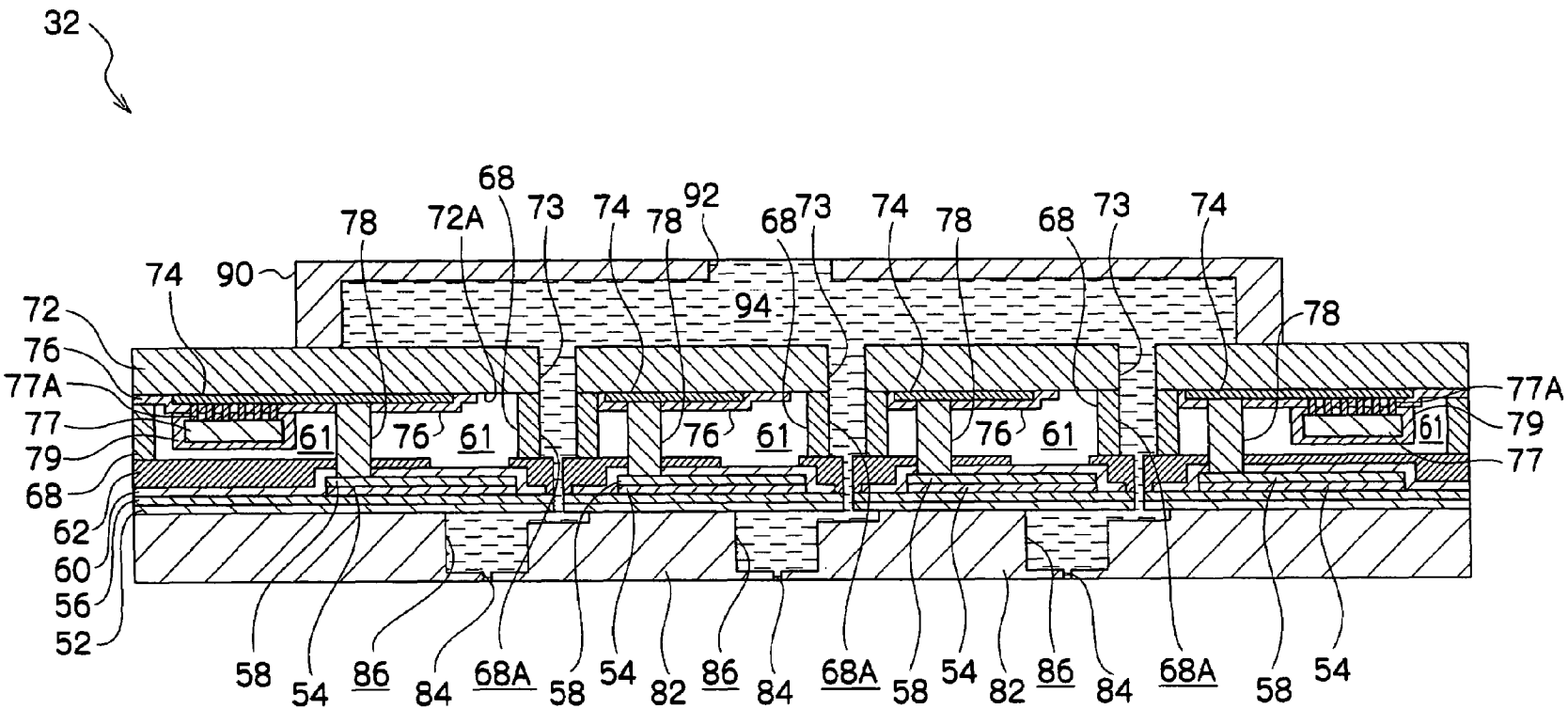
FIG. 4 is a cross-sectional drawing showing the structure of the inkjet recording head of the first embodiment.

Next, detailed explanations will be given regarding the inkjet recording head 32 in the inkjet recording device 10 configured as described above. FIG. 4 is a schematic diagram showing the cross-sectional structure of the inkjet recording head 32, and FIG. 5A-5C is a schematic diagram of a portion of FIG. 4 when viewed as a flat surface.

Figure 6:
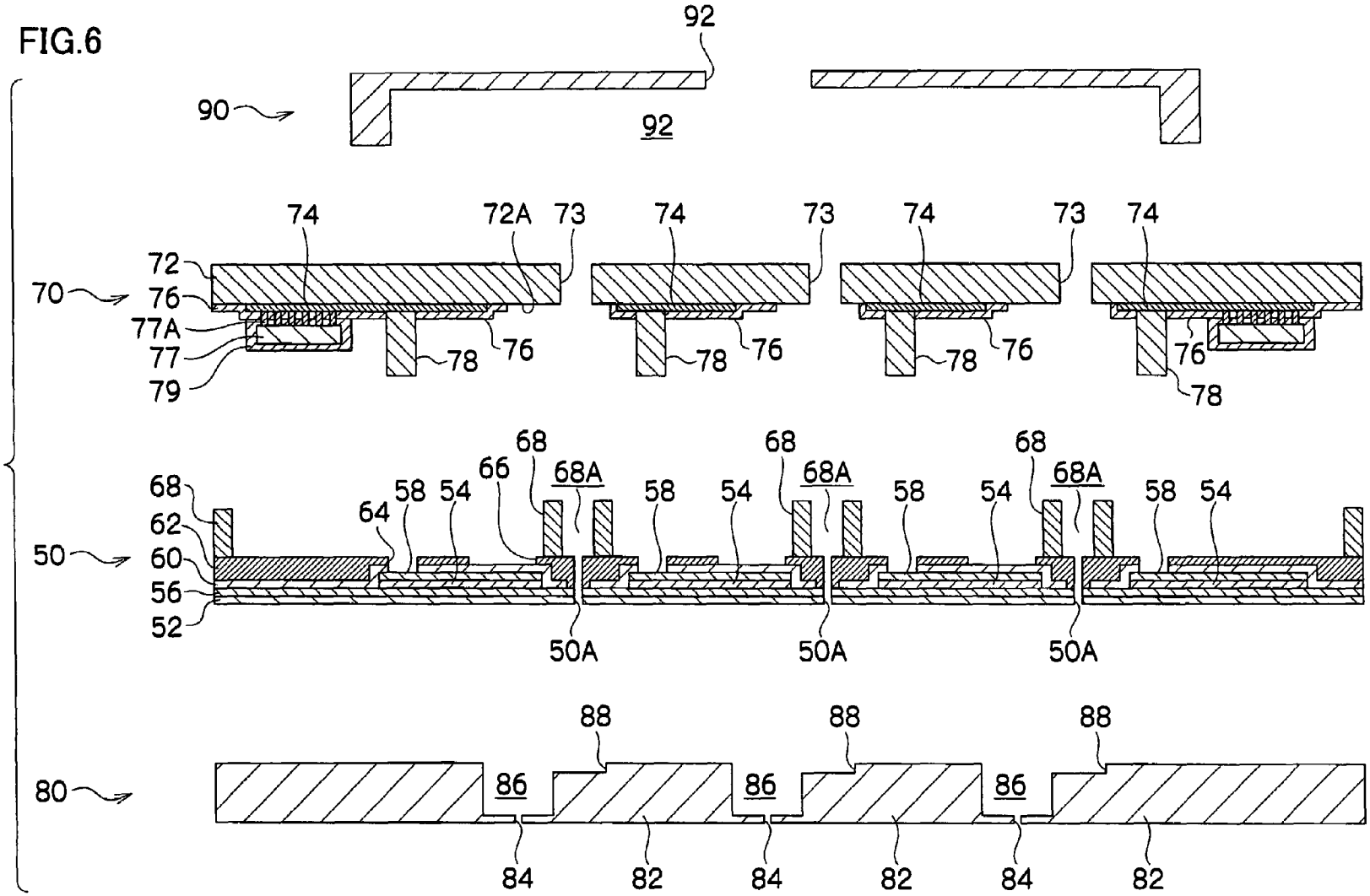
FIG. 6 is a cross-sectional drawing showing the inkjet recording head of the first embodiment exploded into each of its main parts.

As shown in FIG. 6, the inkjet recording head 32 of the present embodiment comprises a channel substrate 80, a piezoelectric element substrate 50, a first upper substrate 70, and an ink pool component 90 stacked and arranged in this order from the bottom side.

Figure 5:
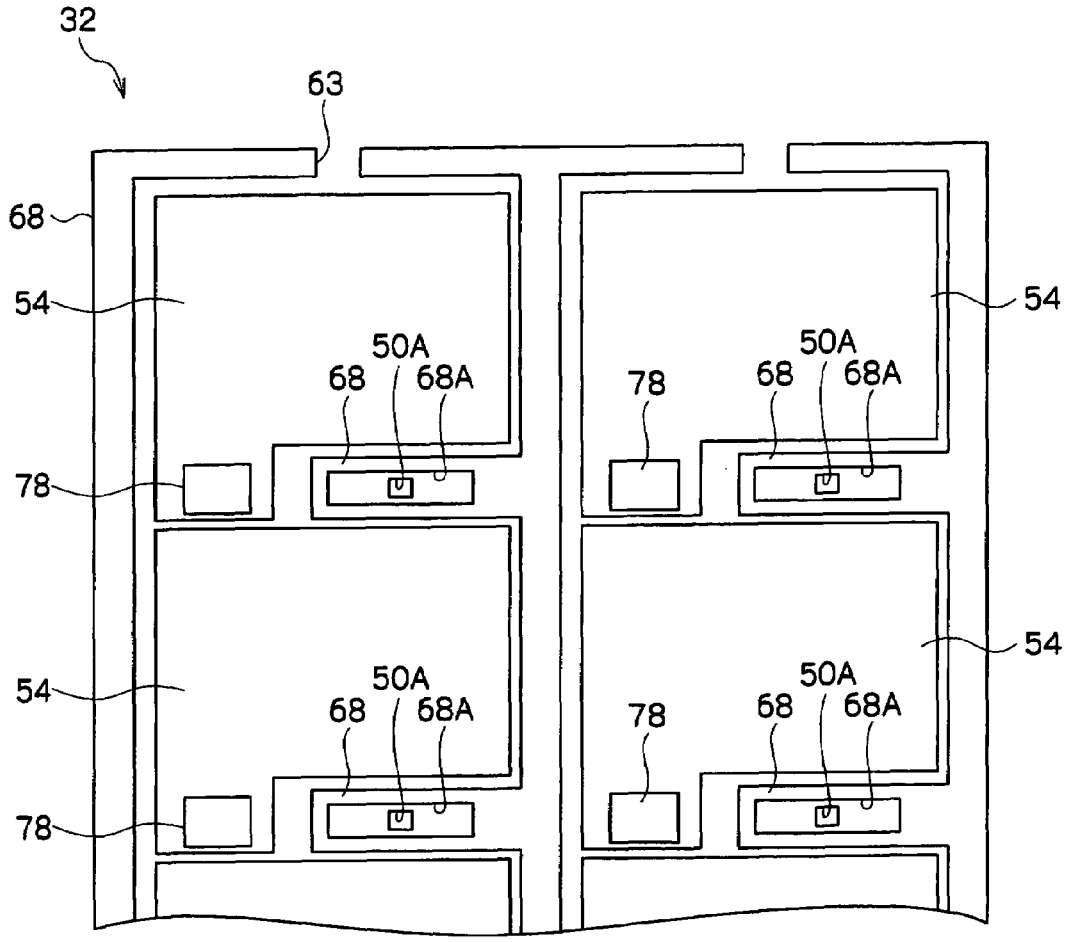
FIG. 5 is a planar drawing of a portion of the inkjet recording head of the first embodiment.

As shown in FIGS. 4, 5, and 6, nozzles 84 that eject ink droplets are formed in a matrix pattern (refer to FIG. 2) in the channel substrate 80, and pressure chambers 86 communicated with the nozzles 84 are formed at each nozzle 84. Ink is filled in the pressure chamber 86. Each pressure chamber 86 is partitioned by a pressure chamber dividing wall 82.

An ink supply port 92 communicated with an ink tank (not shown) is provided in the ink pool component 90. The ink pool component 90 forms an ink pool chamber 94 having a preset shape and volume between the first upper substrate 70 arranged at the bottom side thereof. Ink injected from the ink supply port 92 is accumulated in the ink pool chamber 94.

The first upper substrate 70 is configured to include a glass substrate 72 that is an insulating body having the strength to act as a supporting body. Glass is used in the present embodiment, however, this can be configured from other materials such as ceramic, silicon, resin, and the like.

Metal wiring 74 is formed at the underside surface of the glass substrate 72 (hereafter, at the "facing surface 72A") in order to pass current to a drive IC 77, which will be described later. This metal wiring 74 is formed on the flat glass substrate 72 with no steps and is covered and protected by a resin layer 76.

Bumps 78 are provided at the metal wiring 74. The bumps 78 are electrically connected to an upper electrode 58 of the piezoelectric element substrate 50, which will be described later, and are made such so as to be thicker than the drive IC 77 mounted on the glass substrate 72. The drive IC 77 and a piezoelectric element 54 are electrically connected via the metal wiring 74 due to the bumps 78.

Through-holes 73 for supplying ink accumulated in the ink pool chamber 94 to the pressure chambers 86 are formed in the glass substrate 72. A through-hole 73 is formed individually for each pressure chamber 86.

The drive ICs 77 are mounted on the facing surface 72A of the glass substrate 72, and are arranged in positions at the ends of the glass substrate 72 that do not face the piezoelectric element 54, which will be described later. The drive IC 77 is stored between the piezoelectric element substrate 50 and the first upper substrate 70, and the periphery of the drive IC 77 is sealed with a resin material 79.

The piezoelectric element substrate 50 is configured to include an diaphragm 52 and the piezoelectric element 54.

The diaphragm 52 is arranged on the upper side of the channel substrate 80 and forms the upper portion of each of the pressure chambers 86. The diaphragm 52 is formed from a metal such as SUS and has elasticity in at least the up and down directions, and is configured to flex deform (i.e., displace) in the up and down directions when current is passed to the piezoelectric element 54 (i.e., when voltage is applied thereto). It should be noted that even if the diaphragm 52 is an insulating material such as glass, there are no disadvantageous effects in this regard.

The piezoelectric elements 54 are arranged in a matrix pattern and provided one for each pressure chamber 86 and, when viewed as a flat surface, cover the pressure chambers 86. A lower electrode 56 acting as a one-way polar is arranged at the undersurface of the piezoelectric element 54, and an upper electrode 58 acting as a polar in the other way is arranged at the upper surface of the piezoelectric element 54. The lower electrode 56 side is adhered to the diaphragm 52, and the upper electrode 58 side faces the first upper substrate 70. It should be noted that the diaphragm 52 made of metal (e.g., SUS) contacting the lower electrode 56 is also made to function as low-resistance GND wiring.

A protective layer 60 is laminated on the piezoelectric element 54 and the exposed portions of the lower electrode 56. A resin component 62 is arranged on the upper side of the protective layer 60. Contact holes 64 for connecting the bumps 78 to the upper electrode 58 and free space ports 66 for aiding (i.e., not inhibiting) deformation of the diaphragm 52 are formed in the resin component 62.

Bumps 78 are connected on the upper electrode 58. The drive IC 77 and the piezoelectric element 54 are electrically connected via the metal wiring 74 due to these bumps 78. For this reason, individual wiring on the piezoelectric element substrate 50 becomes unnecessary. Voltage is applied to the piezoelectric element 54 from the drive IC 77 at preset timing and the diaphragm 52 flex deforms in the up and down directions, whereby the ink filled in the pressure chamber 86 is pressurized and ink droplets are ejected from the nozzle 84.

Supply holes 50A that are communicated with the pressure chambers 86 are made in the piezoelectric element substrate 50. The supply holes 50A are configured sa as to pass through the diaphragm 52, lower electrode 56, and resin component 62. The supply holes 50A are holes that are minute and precise and which have the capability of adjusting the channel resistance of the ink. The supply holes 50A are communicated with the pressure chambers 86 due to being in communication with a horizontal channel 88 that is provided so as to extend towards the horizontal direction from the pressure chambers 86 of the channel substrate 80. When manufacturing the inkjet recording head 32, this horizontal channel 88 is provided in advance so as to be slightly longer than the portion connecting to the actual supply holes 50A so that alignment with the supply holes 50A is possible (i.e., so as to be communicated therewith with certainty).

As shown in FIG. 4, rib dividing walls 68 forming supply routes 68 communicated with the supply holes 50A and also with the through-holes 73 of the second upper substrate 71 are provided on the supply holes 50A. The bore diameter of the supply routes 68 formed by the rib dividing walls 68 is almost the same as the through-holes 73, and the bore diameter of the supply holes 50A is, when compared with the supply route 68A, a small bore diameter. The bore diameter is made such that the channel resistance of the supply route 68A relative to the channel resistance of the supply holes 50A is negligible.

As shown in FIG. 6, the rib dividing walls 68 are arranged not only at positions that form the supply routes 68A but also at the periphery of the piezoelectric element 54. As with the bumps 78, the rib dividing walls 68 are made to be thicker than the drive ICs 77 mounted on the first upper substrate 70. Spaces 61 are formed between the piezoelectric element substrate 50 and the first upper substrate 70 due to these rib dividing walls 68. These spaces 61 are communicated with the outside air by air communication ports 63. Changes in pressure within the spaces 61 by displacement of the diaphragm 52 due to the spaces 61 being in an airtight state are prevented, and this is to avoid air in the interior expanding due to heat during the manufacturing process.

With the inkjet recording head 32 configured as described above, the pressure chambers 86 are formed at the bottom side of the piezoelectric element substrate 50, and the ink pool chamber 94 is formed on the upper side of the first upper substrate 70, so these are configured such that both groups do not exist on the same horizontal plane. Accordingly, it becomes possible to arrange the pressure chambers 86 in a state where they are in close proximity with each other, and the nozzles 84 can be set in a highly dense arrangement in a matrix pattern. Specifically, the nozzle resolution in electric connections with conventional FPC systems have had a limit of 600 nozzles per pitch (npi), however, with the system of the present invention, a 1200 npi arrangement was easily made possible. Further, with regard to size, the present invention does not utilize FPC so in comparison to the example of a 600 npi nozzle arrangement, a size of half or less was made possible.

Moreover, the ink pool chamber 94 is wide and there is little dead water region so bubbles can be adequately removed.

Further, the wiring from the individual piezoelectric elements 54 is lifted up to the first upper substrate 70 side due to the bumps 78 so the metal wiring 74 can be formed on a flat glass substrate 72. When compared to when metal wiring is formed on the piezoelectric element substrate 50, the wiring can be easily formed (this is due to the fact that if it is on the side of the piezoelectric element substrate 50, it is necessary to form wiring that has a step due to the piezoelectric element 54).

Furthermore, the drive IC 77 is mounted on the first upper substrate 70. For this reason, the large bumps for connecting the first upper substrate 70 and the piezoelectric element substrate 50 at the regions where the piezoelectric elements 54 are not arranged, such as a case where the drive ICs 77 are mounted on the piezoelectric element substrate 50, become unnecessary, so the inkjet recording head 32 can be made to be more compact.

Further, the drive ICs 77 that apply voltage to the piezoelectric elements 54 are disposed into the interior of the inkjet recording head 32 so when compared to a case where the drive ICs 77 are mounted at the exterior of the inkjet recording head 32, the length of the metal wiring 74 connecting between the 54 and the drive ICs 77 can be made shorter, thereby achieving the making of the metal wiring 74 to have lower resistance.

The drive IC 77, which becomes a heat source, is mounted on the first upper substrate 70 so, when compared to when it is mounted on the piezoelectric element substrate 54, increases in the temperature of the ink within the pressure chamber 86 can be suppressed. Due to this, ink droplet volume variations due to ink temperature irregularities inside the pressure chamber 86 can be suppressed.

Further, with the inkjet recording head 32 configured as described above, the spaces 61 are formed by the rib dividing walls 68 so, when compared to when no spaces 61 are formed (i.e., when ink is filled in the hollow portions), different types of interfaces that contact the ink can be lessened and the choices of the interior processing can be increased (e.g., Au sputtering can be utilized).

Moreover, since the spaces 61 are formed, the ink can be easily kept separate from the piezoelectric elements 54 and inhibition of deformation of the diaphragm 52 can be prevented.

Next, the manufacturing process of the inkjet recording head 32 configured as described above will be explained in detail based on FIGS. 7 through 13.

Figure 7:
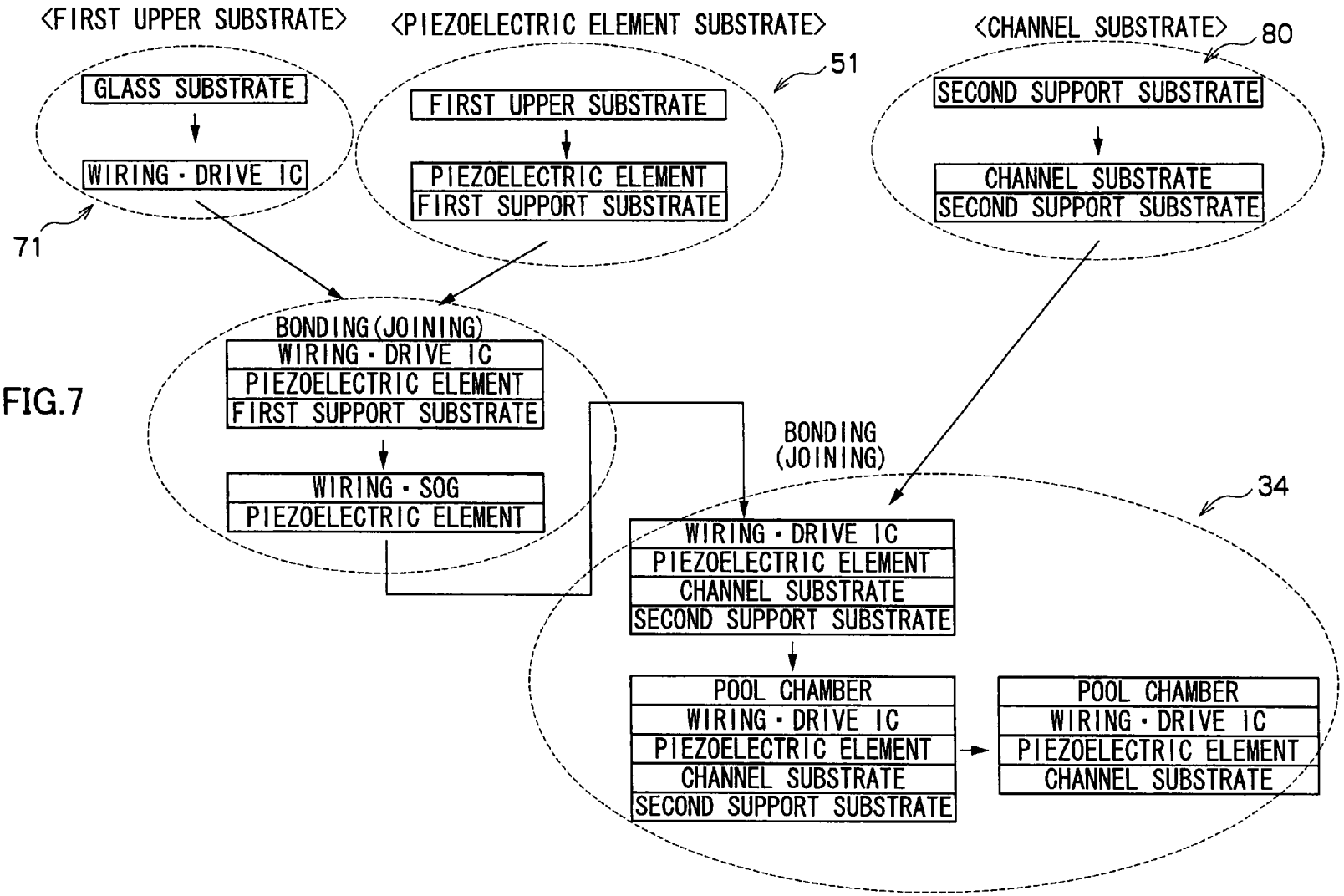
FIG. 7 is an explanatory diagram of the entire process of manufacturing the inkjet recording head of the first embodiment.

As shown in FIG. 7, this inkjet recording head 32 is manufactured by making each of the first upper substrate 70, piezoelectric element substrate 50, and channel substrate 80 separately and by attaching (i.e., joining) these. First, the manufacturing process of the piezoelectric element substrate 50 will be explained.

Figures 8A, 8B, 8C, 8D, 8E, 8F:
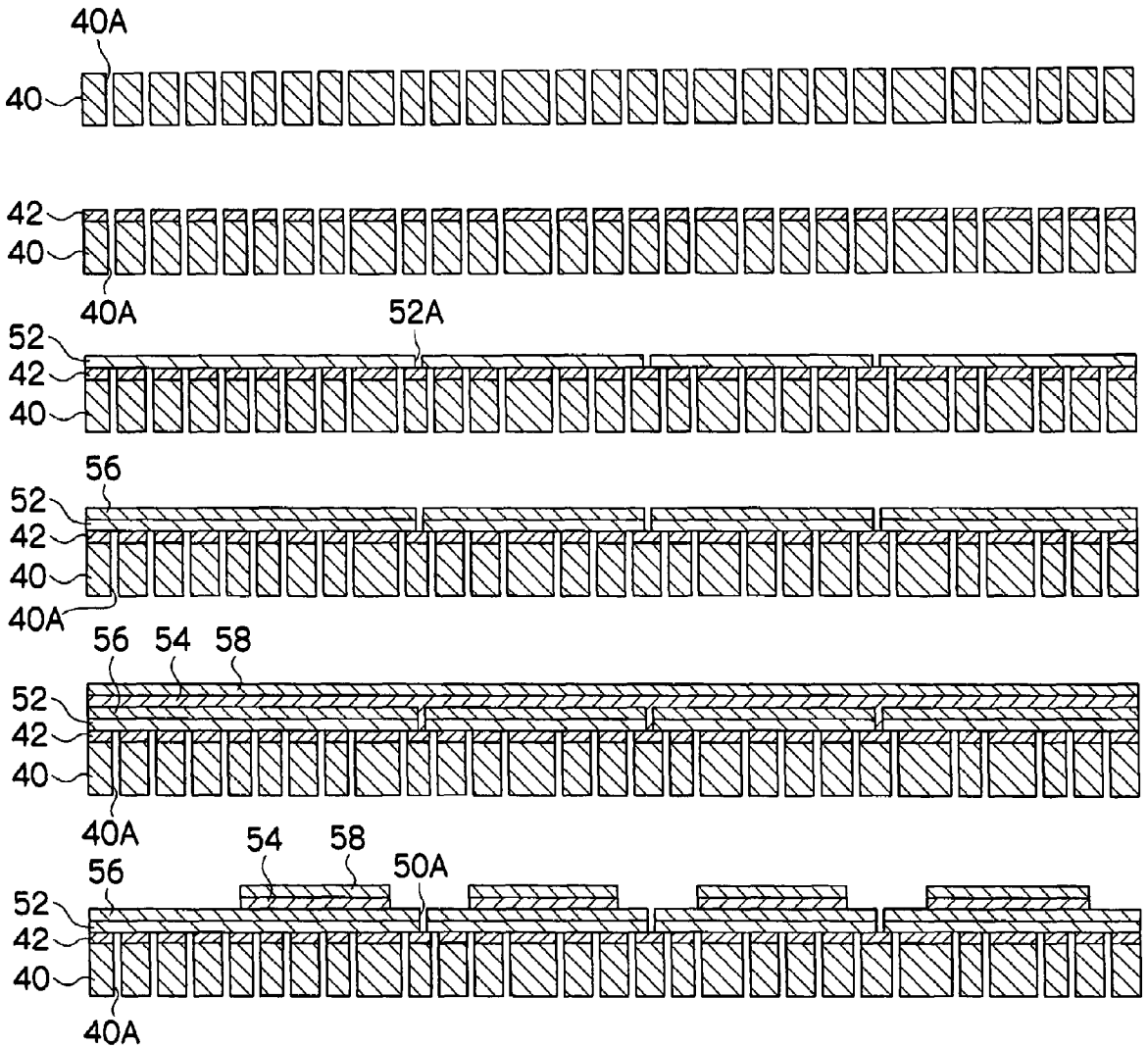
FIG. 8A-8I are explanatory diagrams showing the processes of manufacturing a piezoelectric element substrate.

First, as shown in FIG. 8A, a first support substrate 40 made of glass is prepared in which multiple through-holes 40A are provided. The first support substrate 40 can be made from any material as long as it does not flex, and although it is not limited to glass, glass is preferable in that it is both hard and cheap. With regard to the method of making this first support substrate 40, blast processing of a glass substrate and femtosecond laser processing are known, and others as well such as processes involving exposing and developing a photosensitive glass substrate (e.g., the PEG3C made by the Hoya Corporation).

Then, as shown in FIG. 8B, a resin adhesive 42 is coated on the upper surface (i.e., on the surface) of the first support substrate 40 and then, as shown in FIG. 8C, the diaphragm 52 made of metal (e.g., SUS) is adhered to the upper surface thereof. At this time, the through-holes 52A of the diaphragm 52 and the through-holes 40A of the first support substrate 40 are made so as to not be compounded (i.e., so as to not overlap). It should be noted that there are no adverse affects to using an insulating substrate such as glass and the like for the material of the diaphragm 52.

Here, the through-holes 52A of the diaphragm 52 are formed for the use of the supply holes 50A. Further, the reason the through-holes 40A are provided in the first support substrate 40 is so that a chemical (i.e., solvent) can be poured in at the interface of the first support substrate 40 and diaphragm 52 at a later process, and for liquefying the resin adhesive 42 and separating the first support substrate 40 thereof from the diaphragm 52. Further, the through-holes 40A of the first support substrate 40 and the through-holes 52A of the diaphragm 52 are made to not overlap so that each of the types of materials used during manufacturing do not seep from the bottom surface (i.e., back surface) of the first support substrate 40.

Next, as shown in FIG. 8D, the lower electrode 56 layered on the upper surface of the diaphragm 52 is subjected to patterning. Specifically, this is patterned by resist formation with metal layer sputtering (with a layer thickness of between 500 Å and 3000 Å) or with a photolithographic method, or by resist peeling with patterning (RIE) or oxygen plasma. This lower electrode 56 becomes the ground potential.

Further, as shown in FIG. 8E, a PZT layer that is the material of the piezoelectric element 54 and the upper electrode 58 are layered in this order with a sputtering method on the lower electrode 56, and as shown in FIG. 8F, the piezoelectric element 54 (i.e., PZT layer) and the upper electrode 58 are patterned.

Specifically, resist formation is performed with PZT layer sputtering (with a layer thickness of 3 μm to 15 μm), metal layer sputtering (with a layer thickness of between 500 Å and 3000 Å) or with a photolithographic method, and resist peeling is performed with patterning (i.e., RIE) or oxygen plasma.

It should be noted that for the electrode material of the upper and lower portions, materials having heat resistance and high compatibility with the PZT material that is the piezoelectric element can be used, such as Au, Ir, Ru, and Pt.

Figure 8G:
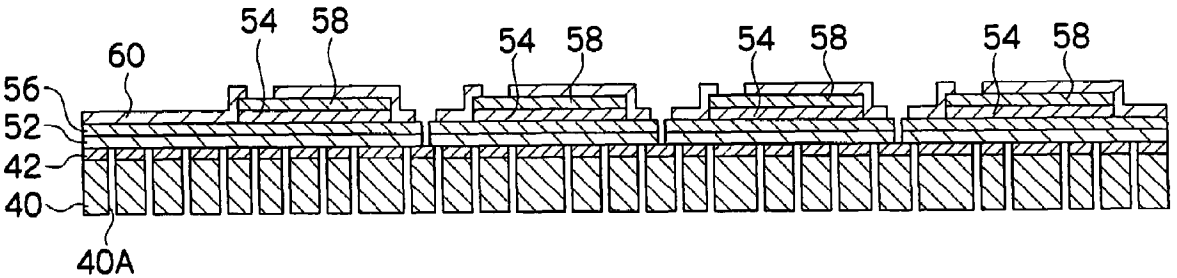

After that, as shown in FIG. 8G, the protective layer 60 comprising an insulating layer with low water permeability is layered on the upper surfaces of the lower electrode 56 and upper electrode 58 exposed at the upper surface. Specifically, processing is performed where an SiOx layer that is an insulating layer with low water permeability having a high degree of dangling bond density is coated on with chemical vapor deposition (CVD); patterning is performed where a photosensitive polyimide (e.g., the photosensitive polyimide Durimide 7520 made by FUJIFILM Arch Co., Ltd.) is coated, exposed, and developed; and etching of the SiOx layer with above photosensitive polyimide as a mask is performed with a reactive ion etching (RIE) method using $CF_4$ gas. It should be noted that although a SiOx layer was used as the insulating layer having low water-permeability, another layer such as a SiNx layer or SiOxNy layer can also be used.

Figure 8H:
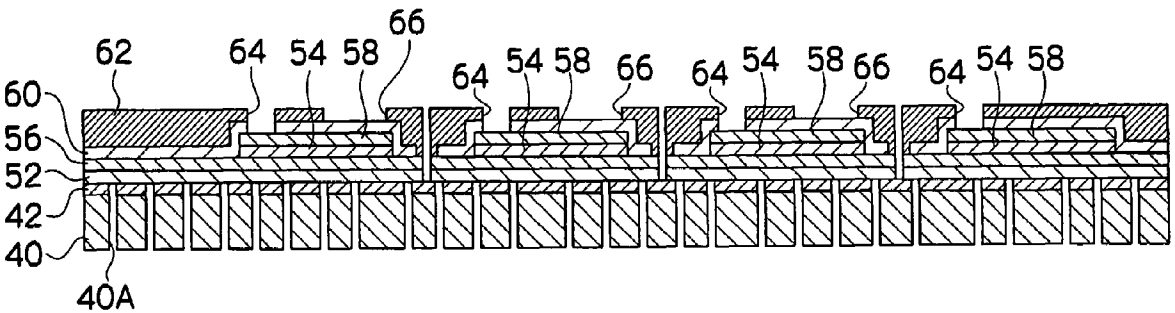

Next, as shown in FIG. 8H, a resin component 62 having ink resistance and flexibility, for example, a resin layer of polyimide, polyamide, epoxy, polyurethane, or silicon and the like, is layered on the upper surface of the protective layer 60 and then patterning is performed. It should be noted that the resin component 62 is made so as to not be layered on the portions joining the bumps 78 (contact holes 64) and the portions positioned at the upper portions of the pressure chambers 86 (free space ports 66). The reason the resin component 62 is not formed on portions positioned above the pressure chambers is to prevent inhibition of deformation of the diaphragm 52 by the resin component 62. Specifically, this is formed by coating a resin material, hardening it with curing processing, resist forming with a photolithographic method (resist including Si), patterning it (RIE), and peeling the resist with oxygen plasma.

Figure 8I:
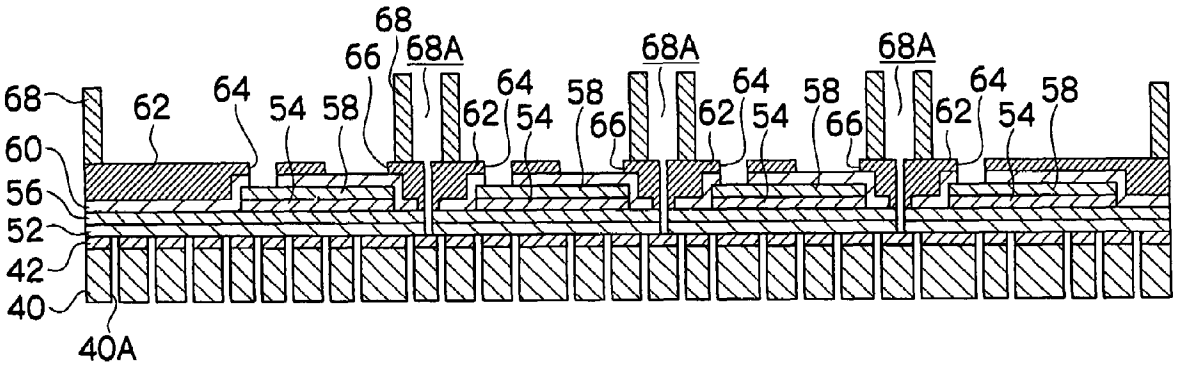

Next, as shown in FIG. 8I, rib dividing walls 68 are formed on the resin component 62. The rib dividing walls 68 are formed by layering a photosensitive resin that is ink-resistant and flexible, such as a layer of polyimide, polyamide, epoxy, polyurethane, or silicon and the like, and then patterning by exposure and development.

The piezoelectric element substrate 50 (attached with the first support substrate 40) is manufactured in this manner.

Figure 9A:
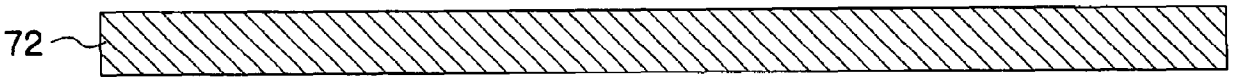
FIG. 9A-9H are explanatory diagrams showing the processes of manufacturing a first upper substrate.

Next, the manufacturing process for making the first upper substrate 70 will be explained. As shown in FIG. 9A, first a glass substrate 72 is prepared. This is not limited to being made of glass, as long as the glass substrate 72 does not flex and is thick enough to act as a support, although glass is preferable in that it is both hard and cost-effective. Notably, in the manufacturing of this first upper substrate 70, the glass substrate 72 is thick enough in itself to ensure the degree of strength necessary to serve as a support (0.3 mm to 1.5 mm), so it is unnecessary to provide a separate support.

Figure 9B:
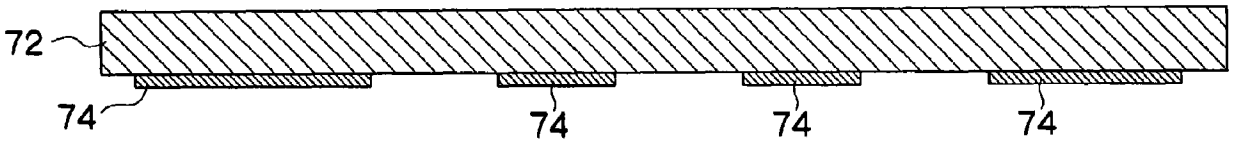

Next, as shown in FIG. 9B, a metal layer is layered on the undersurface (i.e., surface) of the glass substrate 72, and the metal wiring 74 is patterned. Specifically, processing is performed where an A1 layer (with a thickness of 1 μm) is coated with a sputtering method, a resist is formed with a photolithographic method, the A1 layer is etched with an RIE method using a chlorine-based gas, and the resist layer is removed with oxygen plasma.

Figure 9C:
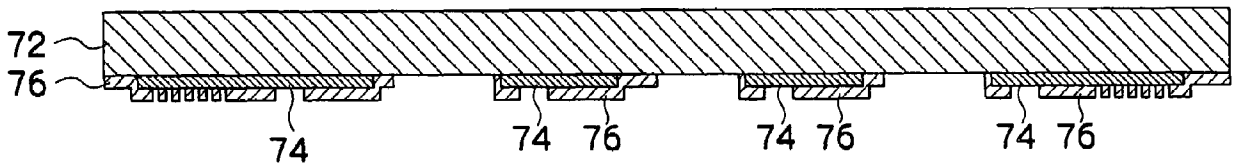

Next, as shown in FIG. 9C, a resin layer 76 is formed on the metal wiring 74. The resin layer 76 is layered thereon so as to not cover the portions that join the bumps 78 for connection with the upper electrode 58 and the portions that join the bumps 77A for mounting the drive ICs 77. Specifically, a photosensitive resin such as a polyimide, polyamide, epoxy, polyurethane, or silicon and the like having resistance to ink and flexibility (e.g., the photosensitive polyimide Durimide 7320 made by FUJIFILM Arch Co., Ltd.) is layered as the resin layer 76 and formed by patterning with exposure and developing.

Figure 9D:
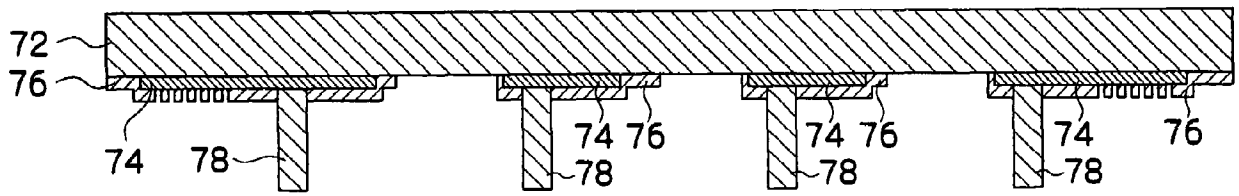

Next, as shown in FIG. 9D, bumps 78 connecting to the metal wiring 74 are formed. Electrical plating, non-electrical plating, ball bump processing, screen printing and the like can be applied to form the bumps 78. The heights of these bumps 78 are made to be taller than the heights of the rib dividing walls 68 in order to make it easier to join to the upper electrode 58 when joining this to the piezoelectric element substrate 50.

Figure 9E:
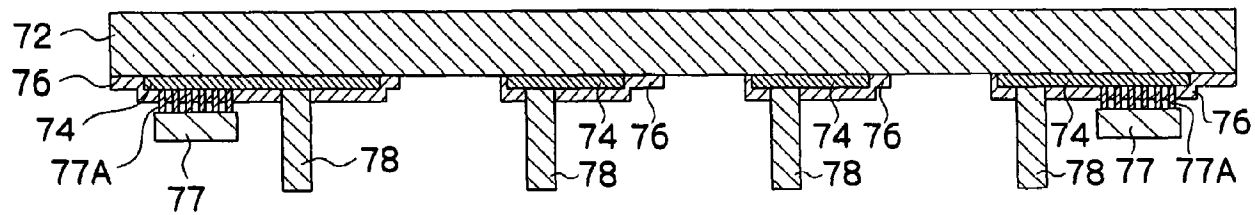

Next, as shown in FIG. 9E, the drive IC 77 are flip chip mounted on the metal wiring 74 via the IC bumps 77A. At this time, the drive IC 77 is processed to a preset thickness (70 μm to 300 μm) with grind processing executed at the end of semiconductor wear processing performed in advance. Electrical plating, non-electrical plating, ball bump processing, screen printing and the like can also be applied to form the IC bumps 77A.

Figure 9F:
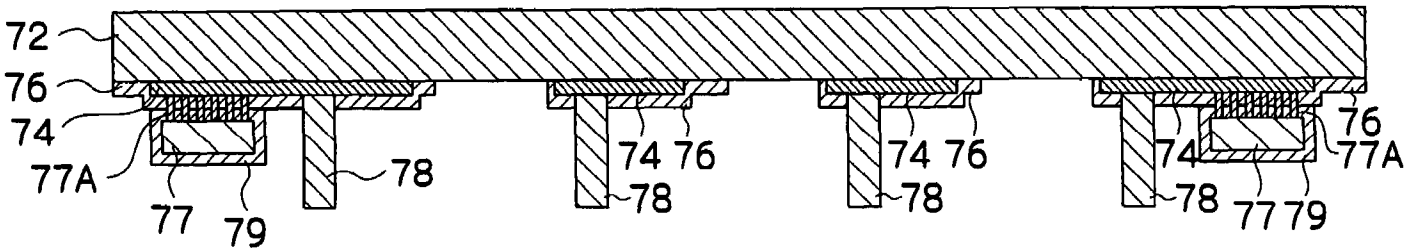
Figure 9G:
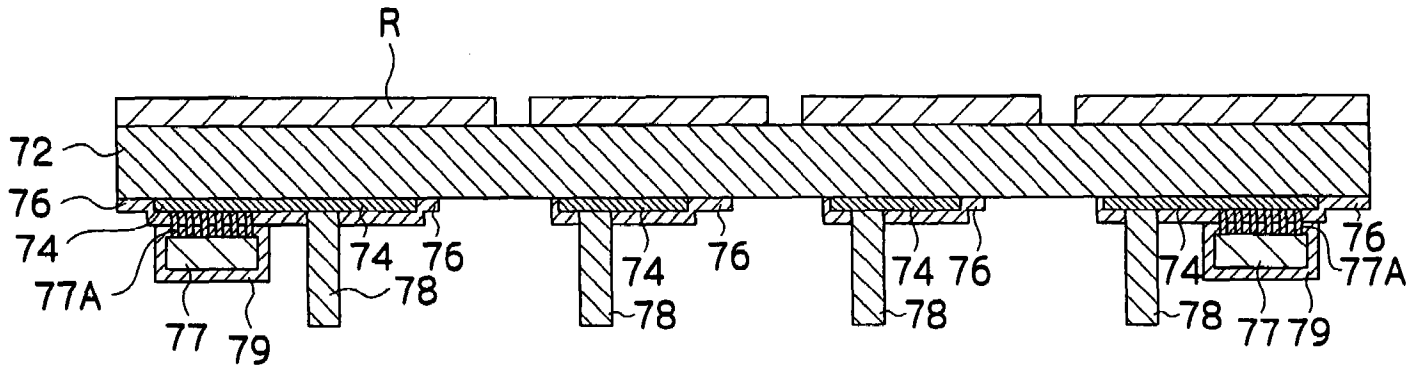

Next, as shown in FIG. 9F, the exposed portions of the drive IC 77 are sealed with a resin material 79. Specifically, this sealing is performed by coating the resin material. In this manner, the drive ICs 77 are sealed with the resin material 79 whereby the drive ICs 77 can be protected from the exterior environment. Further, damage due to later processes such as damage from water or grinding pieces to the completed piezoelectric element substrate 50 due to dicing when dividing the inkjet recording head 32 can be avoided.

Figure 9H:
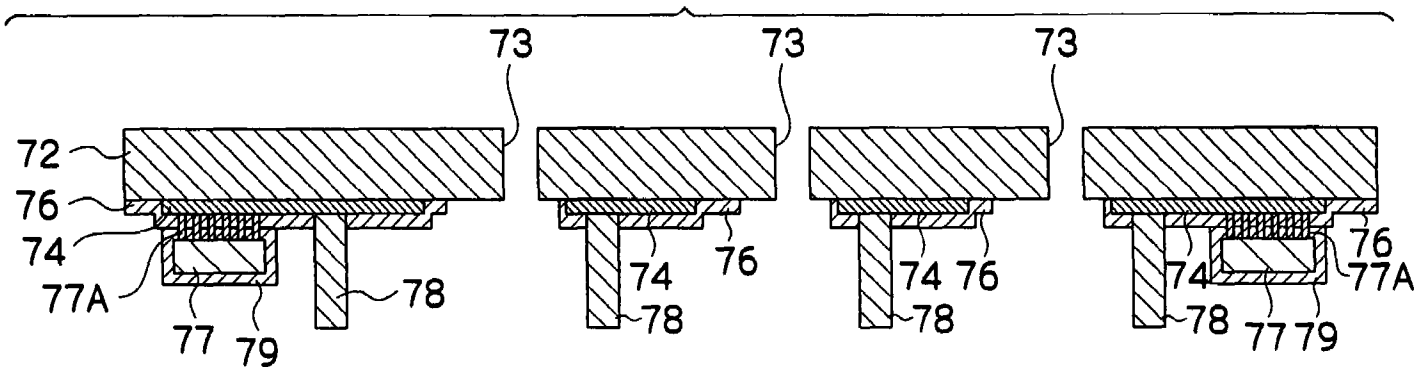

Next, through-holes 73 are formed in the glass substrate 72 so as to let ink pass through. As shown in FIG. 90, formation of the through-holes 73 is maid by first patterning a resist R on the upper surface of the glass substrate 72. Then holes are opened with sandblasting and the resist is removed, whereby, as shown in FIG. 9H, the through-holes 73 are formed.

The first upper substrate 70 is manufactured in this manner.

Next, the process for binding (i.e., joining) the piezoelectric element substrate 50 and the first upper substrate 70 will be explained.

Figures 10A, 10B, 10C:
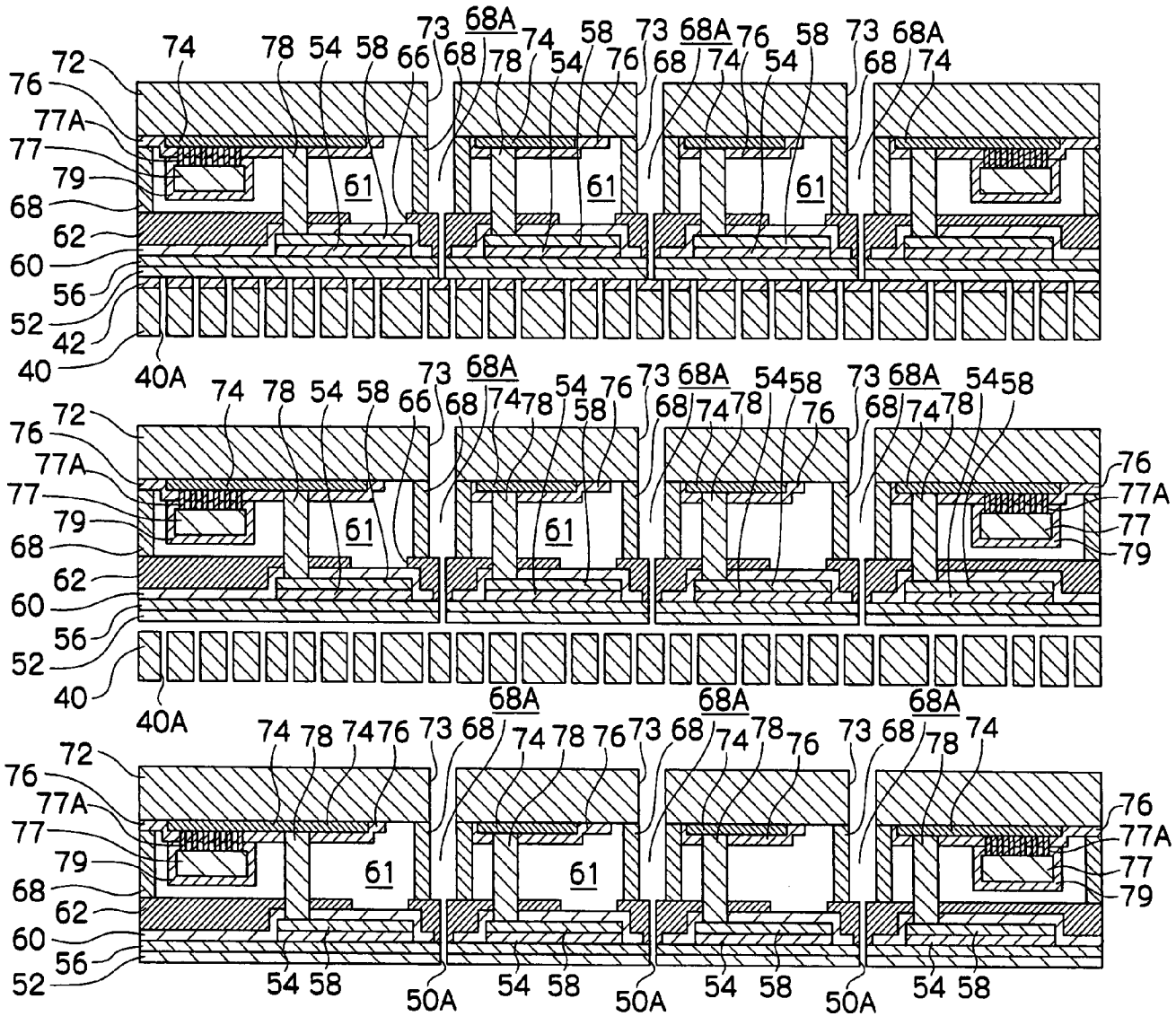
FIG. 10A-10C are explanatory diagrams showing the processes of joining the piezoelectric element substrate and the first upper substrate.

As shown in FIG. 10(A), the side of the piezoelectric element substrate 50 and rib dividing walls 68 is made to face the side on which the bumps 78 of the first upper substrate 70 are formed, and these are both connected (i.e., bonded together) with thermocompression. That is, the rib dividing walls 68 are bonded to the glass substrate 72 and resin layer 76, and the bumps 78 to the upper electrode 58.

At this time, the bumps 78 are taller than the rib dividing walls 68 so by joining the rib dividing walls 68 to the glass substrate 72 and the resin layer 76, the bumps 78 are automatically joined to the upper electrode 58. That is, height adjustment of the bumps 78 is simple (due to the fact that they are easily deformed) so formation of the supply routes 68A and the spaces 61 with the rib dividing walls 68 can be easily achieved.

Next, as shown in FIG. 10B, a removable adhesive solution (e.g., an organic ethanol amine solvent) is injected from the through-holes 40A of the first support substrate 40, and peeling processing of the first support substrate 40 from the piezoelectric element substrate 50 is performed by selectively dissolving the resin adhesive 42. Due to this, as shown in FIG. 10C, the joined substrate of the first upper substrate 70 and the piezoelectric element substrate 50 is completed.

Next, the manufacturing process for the channel substrate 80 will be explained.

Figures 11A, 11B, 11C, 11D, 11E:
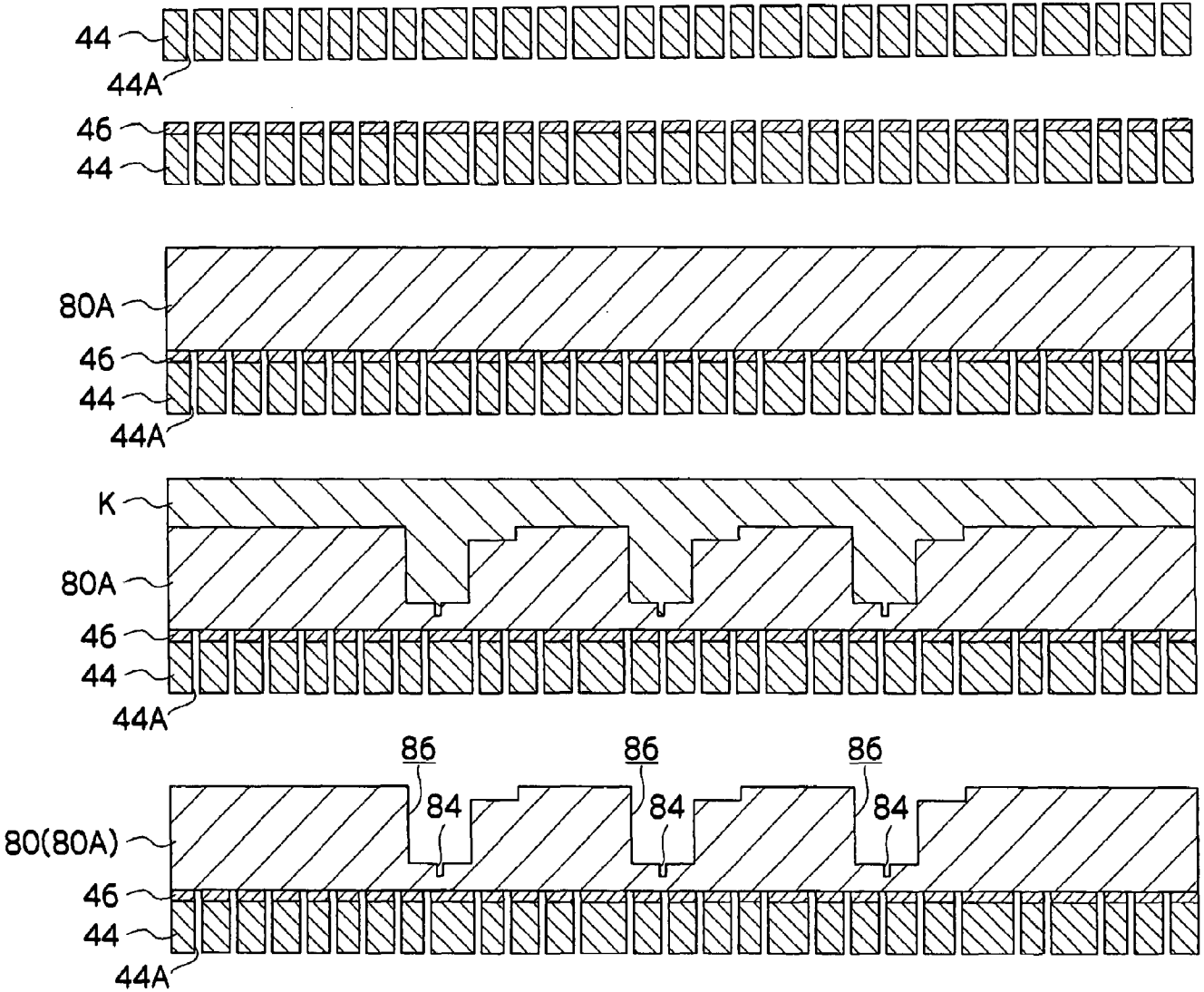
FIG. 11A-11E are explanatory diagrams showing the processes for manufacturing a channel substrate.

First, as shown in FIG. 11A, a second support substrate 44 made of glass is prepared in which multiple through-holes 44A are provided. The second support substrate 44, like the first support substrate 40, can be made from any material as long as it does not flex, and although it is not limited to glass, glass is preferable in that it is both hard and cost effective. With regard to the method of making this second support substrate 44, blast processing of a glass substrate and femtosecond laser processing are known, as well as exposing and developing a photosensitive glass substrate (e.g., the PEG3C made by the Hoya Corporation).

Next, as shown in FIG. 11B, a resin adhesive 46 is coated on the upper surface (i.e., on the surface) of this second support substrate 44, and as shown in FIG. 11C, a resin substrate 80A (e.g., an amide imide substrate with a thickness of 0.1 mm to 0.5 mm) is adhered on the upper surface (i.e., to the surface) thereof. Next, as shown in FIG. 11D, a metal mold K is pressed against the upper surface of the resin substrate 80A and heat/pressure processing is performed. After that, as shown in FIG. 11E, portions such as the pressure chambers 86 and the nozzles 84 are formed due to the removal of the metal mold K from the resin substrate 80A, and the channel substrate 80 (attached to the second support substrate 44) is completed.

Figure 12A:
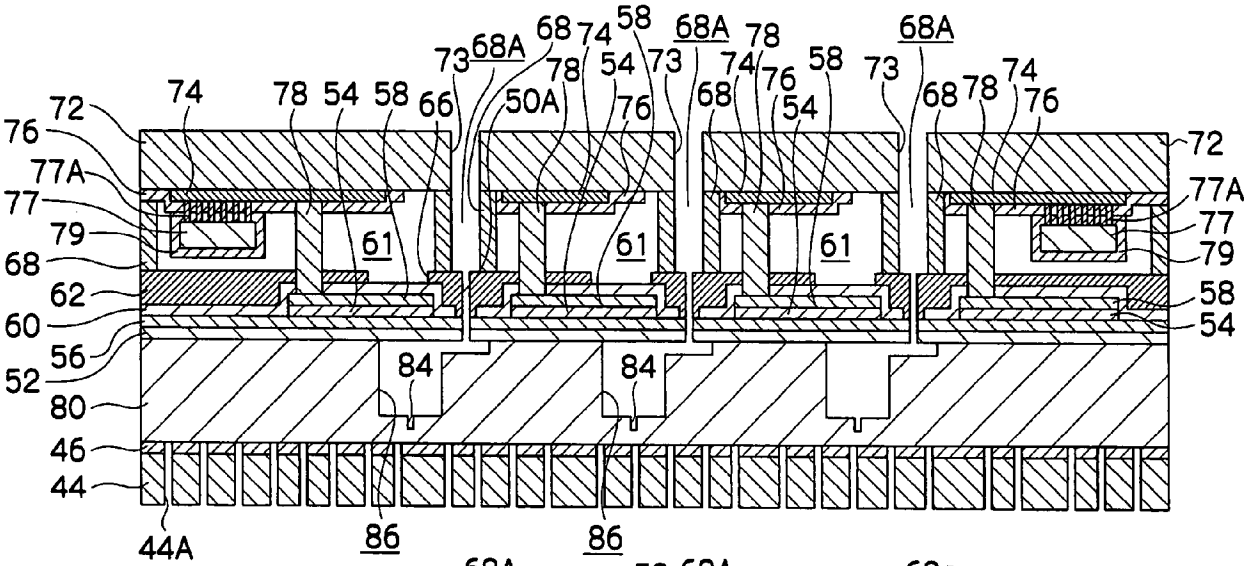
FIG. 12A-12F are explanatory diagrams showing the processes of joining the channel substrate to the joined bodies of the piezoelectric element substrate and the first upper substrate.
Figure 12B:
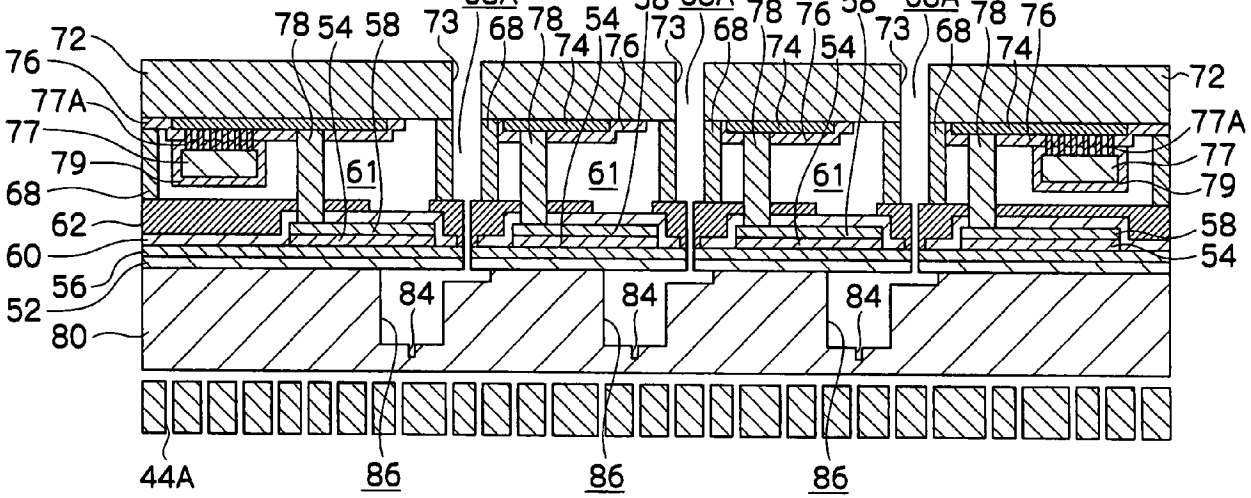

In this way, once the channel substrate 80 is completed, the side of the diaphragm 52 of the piezoelectric element substrate 50 and the side on which the pressure chambers 86 of the channel substrate 80 were formed are connected (i.e., bonded together) with thermocompression, as shown in FIG. 12A. Then, as shown in FIG. 12B, a removable adhesive solution is injected from the through-holes 44A of the second support substrate 44, and removing processing of the second support substrate 44 from the channel substrate 80 is performed by selectively dissolving the resin adhesive 46.

Figure 12C:
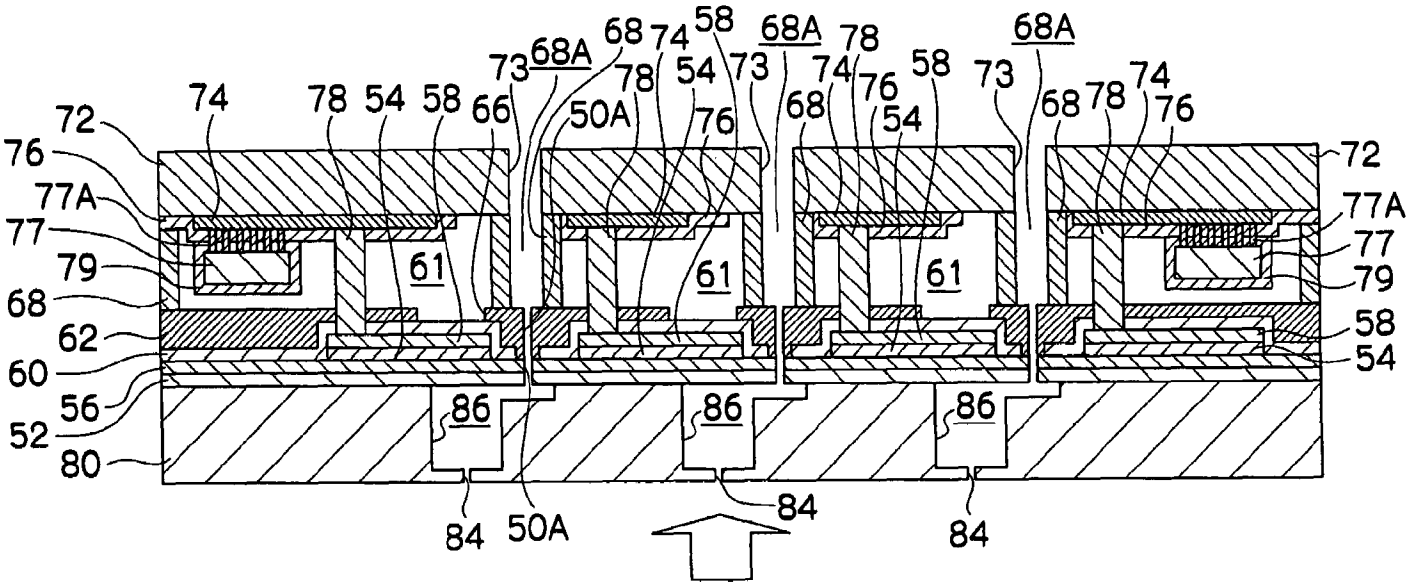
Figure 12D:
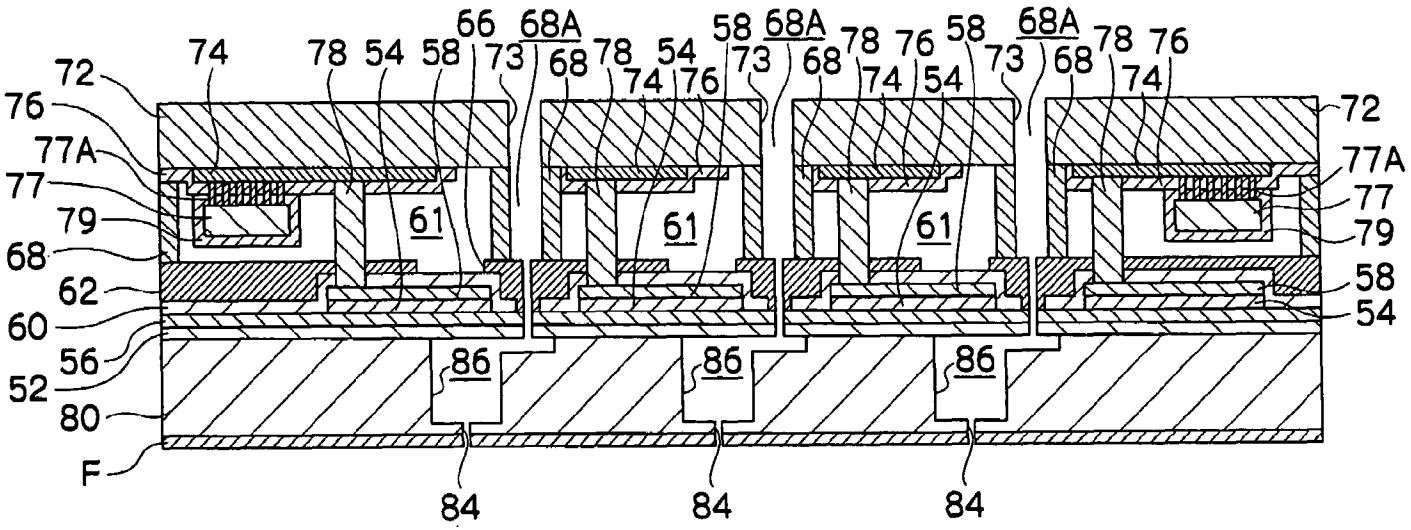

After that, as shown in FIG. 12C, a surface layer of the surface from which the second support substrate 44 was removed is removed with grinding processing using a grinding material having alumina as its principal component, or with RIE processing using oxygen plasma, whereby the nozzles 84 are opened. Then, as shown in FIG. 12D, a fluorine material F (e.g., Cytop produced by the Asahi Glass Co., Ltd.) is coated as a water repellent on the bottom surface where the nozzles 84 were opened.

Figure 12E:
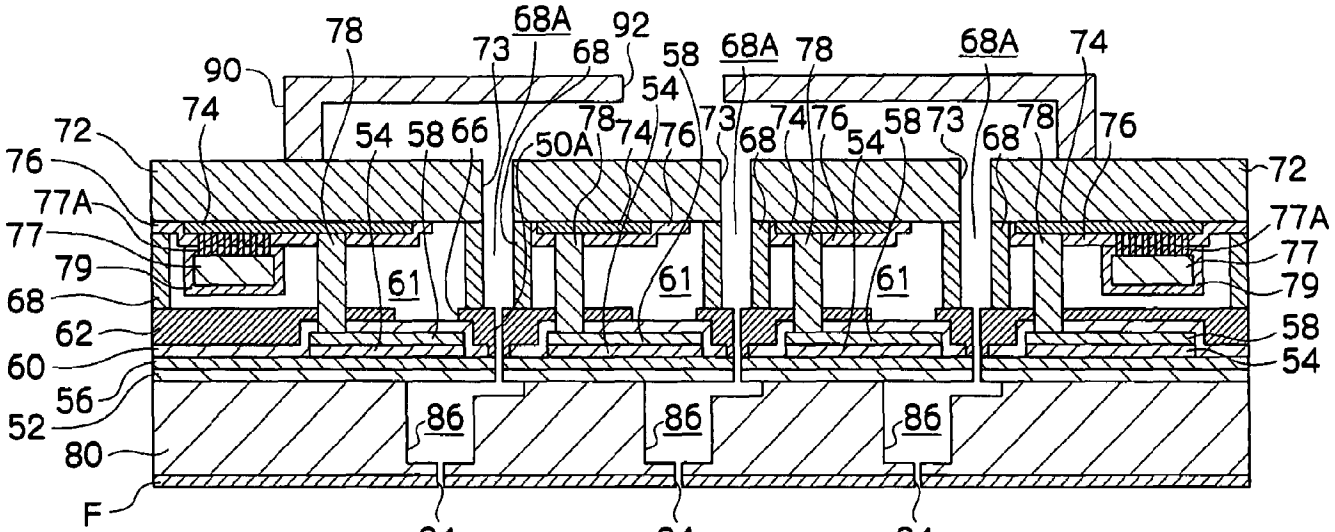
Figure 12F:
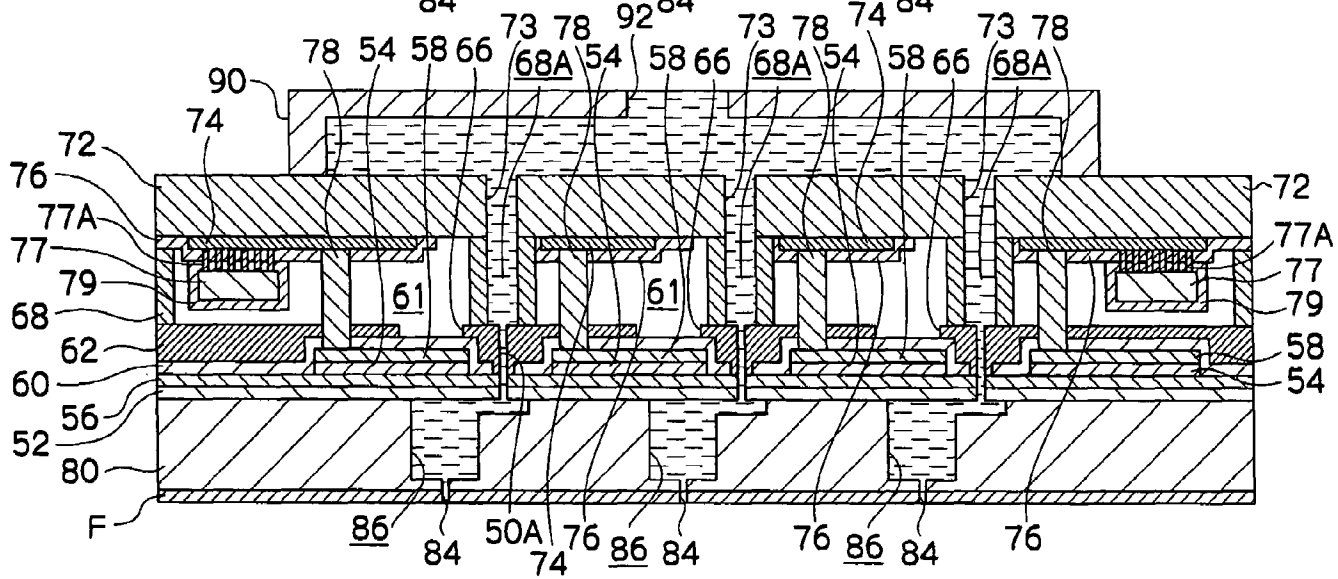

Next, as shown in FIG. 12E, by joining the ink pool component 90 to the upper surface of the first upper substrate 70, the inkjet recording head 32 is completed and ink can be filled inside the ink pool chamber 94 and the pressure chambers 86.

Figure 13:
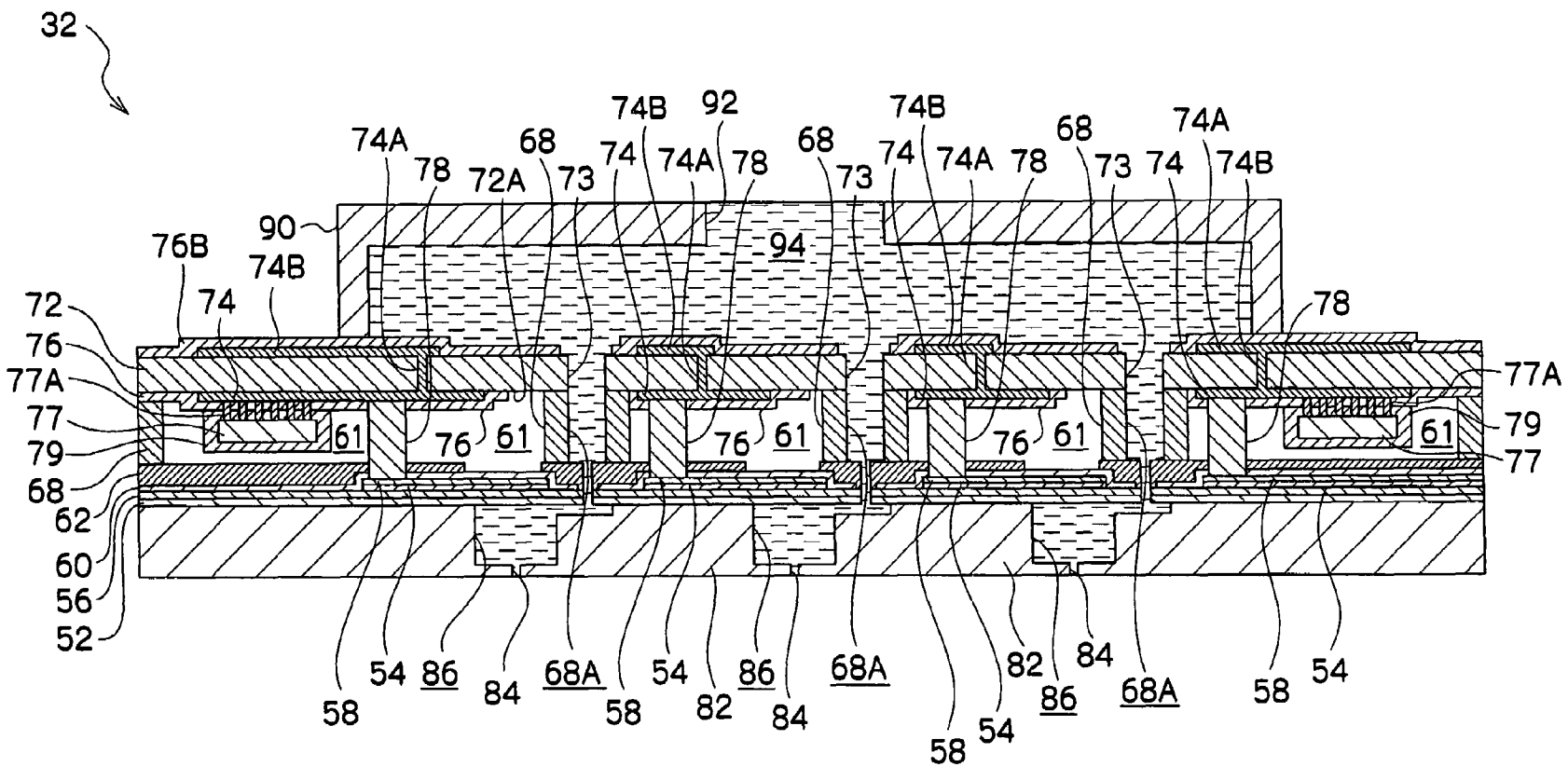
FIG. 13 is a schematic diagram showing the structure of an alternate example of the inkjet recording head of the first embodiment.

It should be noted that in the above-described embodiment, the metal wiring 74 was provided on the bottom surface of the glass substrate 72, however, as shown in FIG. 13, through wiring 74A connected to the metal wiring 74 and upper surface wiring 74B provided on the upper surface side of the glass substrate 72 and connected with the through wiring 74A can be formed at the glass substrate 72 (where the upper surface wiring 74B is covered with a resin layer 76B). In this manner, by forming the upper surface wiring 74B, the wiring area can be expanded without changing the size of the inkjet recording head 32. The upper surface wiring 74B can also be used for other things, such as input signal wiring. Since the upper surface wiring 74B is arranged at the exterior side of the inkjet recording head 32, it can easily be connected to other components such as a control board (not shown).

Figure 14:
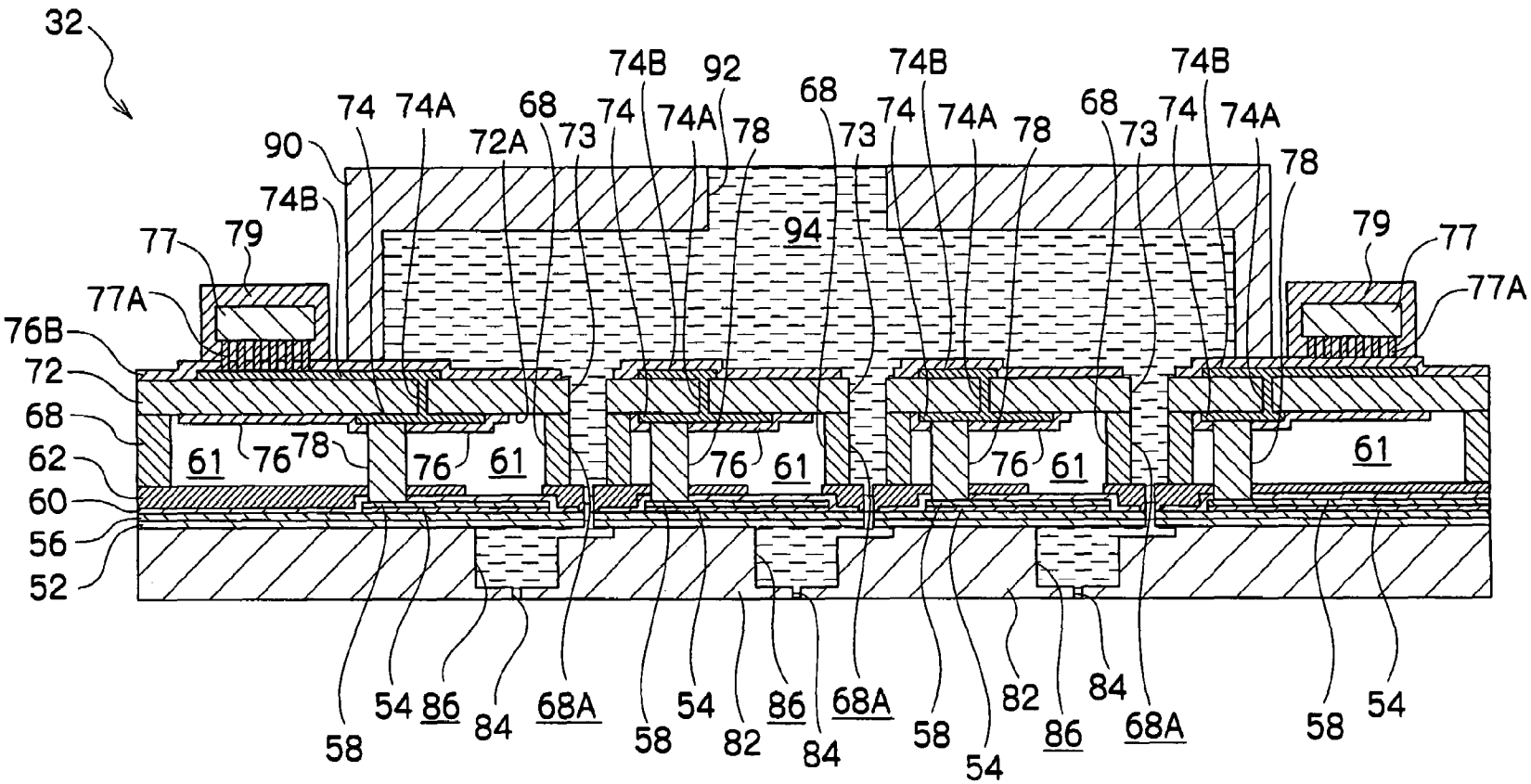
FIG. 14 is a schematic diagram showing the structure of another alternate example of the inkjet recording head of the first embodiment.

Further, in the above-described embodiment, the drive IC 77 was mounted at the undersurface side of the first upper substrate 70, however, as shown in FIG. 14, the drive IC 77 can be mounted on the upper surface side of the first upper substrate 70. In this case, the aforementioned through wiring 74A and upper surface wiring 74B are formed and the drive IC 77 and upper surface wiring 74B are joined with the IC bump 77A. By arranging the drive IC 77 at the exterior side of the inkjet recording head 32 in this manner, the heat-dissipation qualities can be improved.

Figure 15:
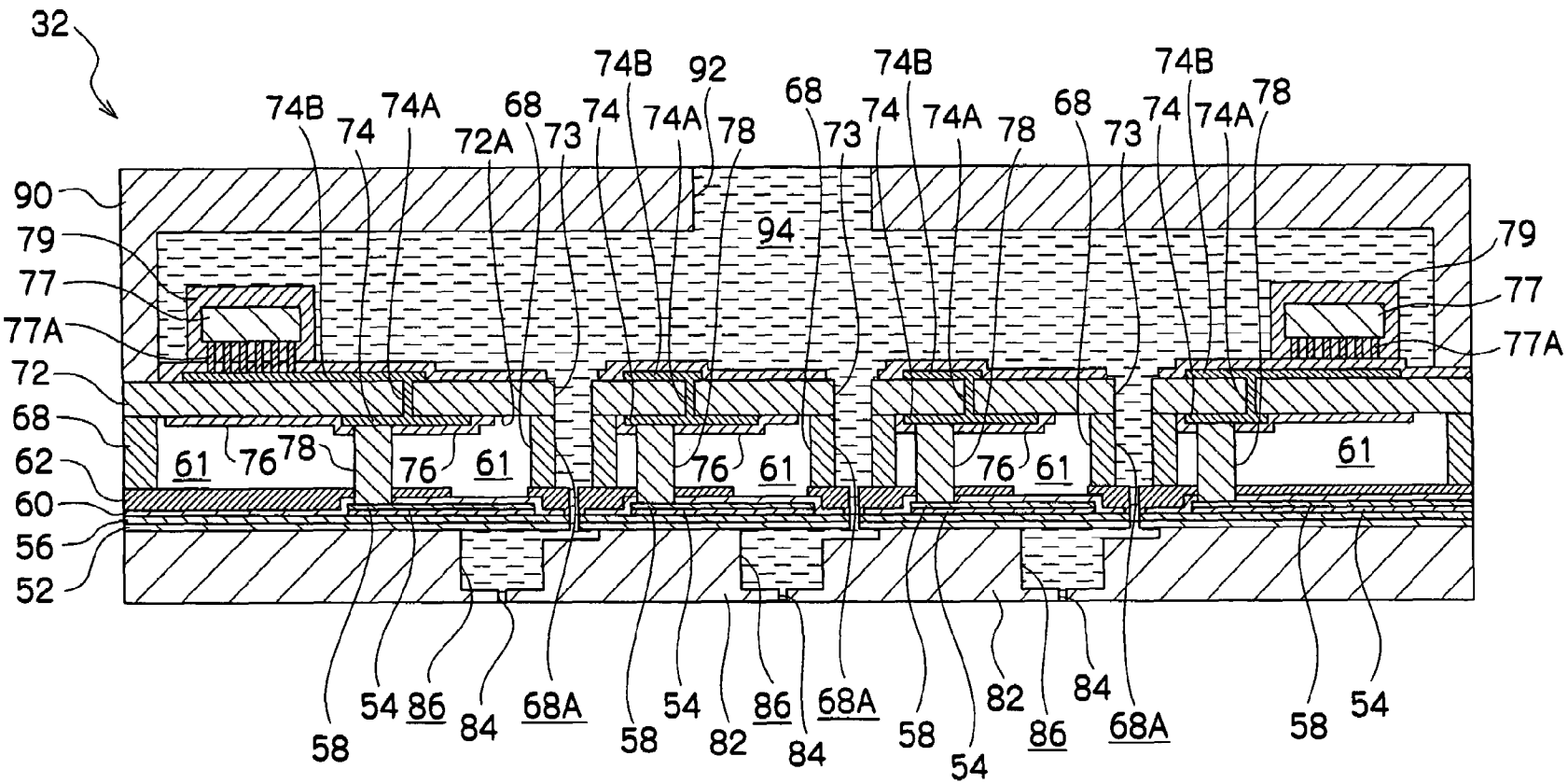
FIG. 15 is a schematic diagram showing the structure of another alternate example of the inkjet recording head of the first embodiment.

Further, as shown in FIG. 15, the ink pool chamber 94 can be expanded and the drive ICs 77 can be arranged within the ink pool chamber 94 on the upper surface of the first upper substrate 70. If these are set inside the ink pool chamber 94, the drive ICs 77 generating heat are cooled by the ink so heat-dissipating qualities can be improved (i.e., due to a water-cooling effect).

Next, the operation of the inkjet recording device 10 provided with the inkjet recording head 32 manufactured as described above will be explained. First, an electric signal instructing to print is sent to the inkjet recording device 10 and one sheet of recording paper P is picked up from the stocker 24 and conveyed to the recording unit 20 with the conveying device 26.

Meanwhile, at the inkjet recording unit 30, ink is already injected (i.e., filled) into the ink pool chamber 94 of the inkjet recording head 32 via the ink supply port 92 from the ink tank. The ink filled in the ink pool chamber 94 is supplied (i.e., filled) to the pressure chamber 86 through the through-hole 73, the supply route 68A, and the supply hole 50A. At this time, a slightly indented meniscus forms on the surface of the ink on the side of the pressure chamber 86 at the ends (i.e., the discharge openings) of the nozzles 84.

Next the recording paper P is conveyed at a preset conveying speed while ink droplets are selectively ejected from the multiple nozzles 84 of the inkjet recording head 32, whereby an image is recorded on the recording paper P based on image data. That is, voltage is applied to preset piezoelectric elements 54 at preset timing due to the drive IC 77, the diaphragm 52 is made to flex deform in the up and down directions (i.e., made to vibrate out-of-plane), the ink within the pressure chamber 86 is pressurized and ejected as ink droplets from preset nozzles 84, and image formation is executed.

The recording paper P is conveyed in the direction of the discharging unit 22 during image formation and discharged to the tray 25 by the paper-exiting belt 23. Due to this, print processing (i.e., image recording) on the recording paper P is completed.

It should be noted that with the present embodiment, an example was explained of paper width corresponding to FWA, however, the inkjet recording head of the present invention is not limited thereto. The present invention can also be applied to a partial width array (PWA) device that has a main scanning mechanism and a sub-scanning mechanism. Since the present invention is particularly effective at realizing highly dense nozzle arrangements, it is quite suitable for FWA, which requires 1-pass printing.

Furthermore, the inkjet recording device 10 of the above-described embodiment was made such that an inkjet recording unit 30 each for black, yellow, magenta, and cyan, were mounted on a carriage 12, and recording was performed by selectively ejecting ink droplets from the inkjet recording heads 32 for each color, whereby a full-color image was recorded on the recording paper P based on image data. Nonetheless, the inkjet recording in the present invention is not limited to recording characters and images on a recording paper P.

In other words, the recording medium is not limited to paper and the ejected liquid is not limited to ink. The inkjet recording head 32 of the present invention can be applied to, for example, general liquid-spraying devices used industrially, such as those used when ejecting ink onto polymer films and glass when making color filters for displays, or for when ejecting solder in a molten state on a substrate when forming bumps for mounting parts.

Second Embodiment

Next, the second embodiment of the present invention will be explained. It should be noted that portions that are the same as in the first embodiment have been given the same part numbers and detailed explanations thereon have been omitted.

The schematic structure of the inkjet recording device 100 of the present embodiment is the same as the inkjet recording device 10 of the first embodiment shown in FIGS. 1 and 2, so detailed explanations thereon have been omitted.

The inkjet recording head 34 set in the inkjet recording device 100 is, when a portion of it is viewed as a flat surface, inkjet recording head 32 of the first embodiment shown in FIG. 5.

The inkjet recording head 34 of the present embodiment comprises a channel substrate 80, a piezoelectric element substrate 50, a second upper substrate 71, and an ink pool component 90 stacked and arranged in this order from the bottom side. The channel substrate 80, piezoelectric element substrate 50, and ink pool component 90 are configured the same as in the first embodiment.

The second upper substrate 71 is configured to include a glass substrate 72 that is an insulating body having the strength to act as a supporting body. Although glass is used in the present embodiment as well, this can be configured from other materials such as ceramic, silicon, resin, and the like.

Metal wiring 74 is formed on the facing surface 72A of the glass substrate 72. This metal wiring 74 is formed on the flat glass substrate 72 with no steps or bumps. Further, thin film transistors 75 are formed at the facing surface 72A for each piezoelectric element 54 and connected to the metal wiring 74. The second upper substrate 71 is what is known as a system on glass (SOG) substrate. The metal wiring 74 and thin film transistor 75 are covered and protected by a resin layer 76. Bumps 78 are provided at the metal wiring 74. The bumps 78 are electrically connected to the piezoelectric element substrate 50 and an upper electrode 58. Due to these bumps 78, the thin film transistor 75 and the piezoelectric element 54 are electrically connected through the metal wiring 74.

Through-holes 73 for supplying ink accumulated in the ink pool chamber 94 to the pressure chambers 86 are formed in the glass substrate 72. A through-hole 73 is formed for each pressure chamber 86.

Figure 16:
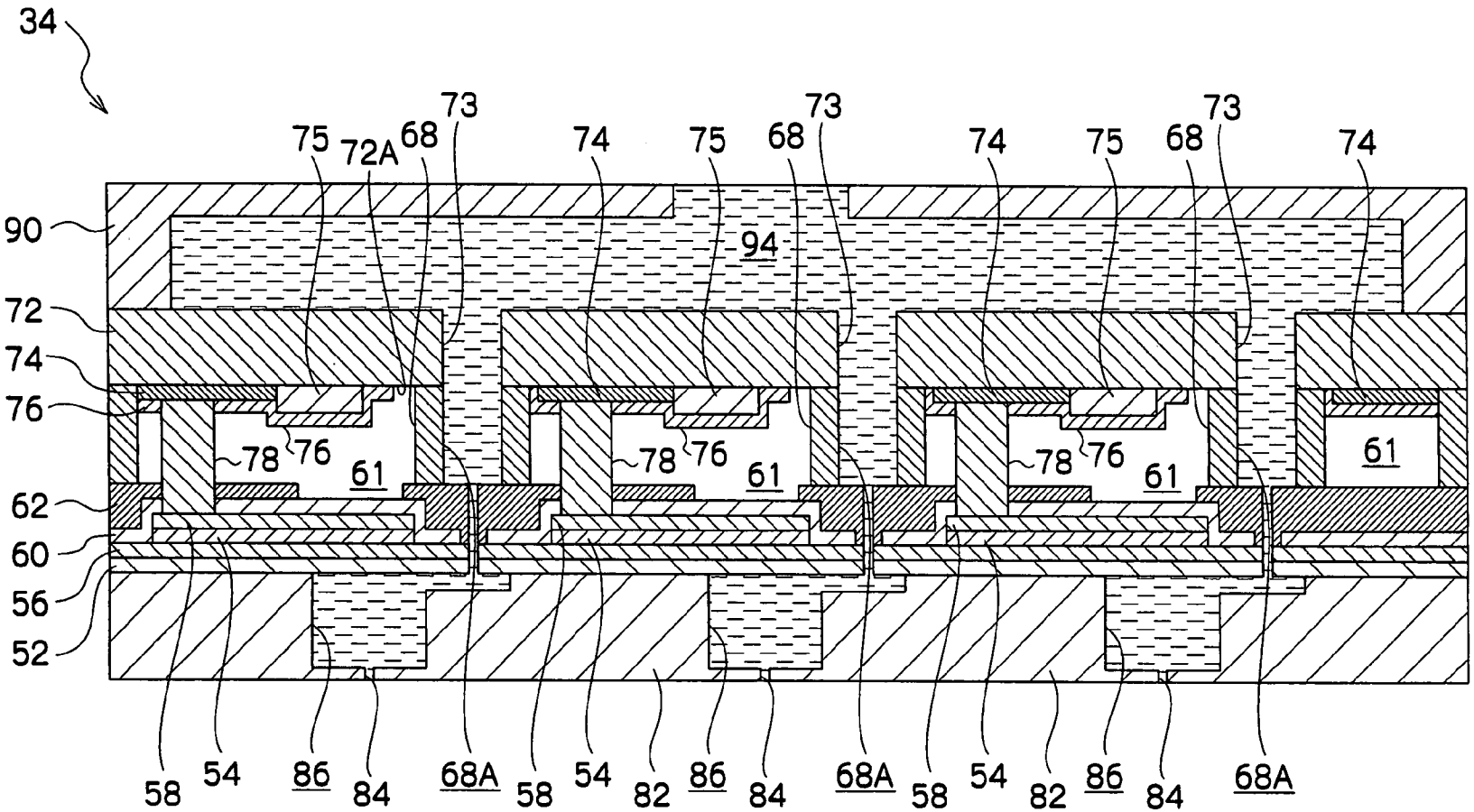
FIG. 16 is a cross-sectional drawing showing the structure of the inkjet recording head of the second embodiment.
Figure 17:
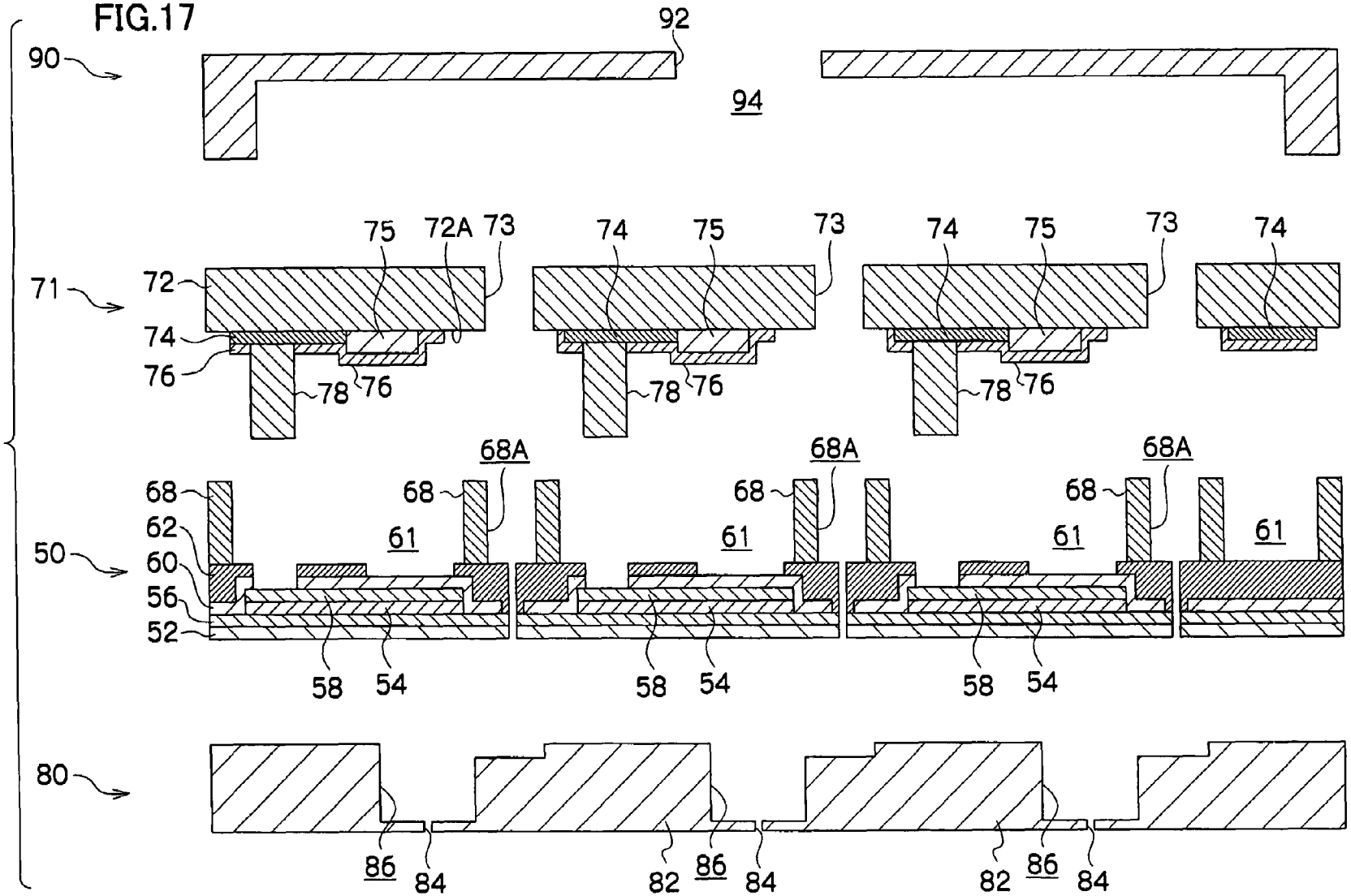
FIG. 17 is a cross-sectional drawing showing the inkjet recording head of the second embodiment exploded into each of its main parts.

As shown in FIG. 16, rib dividing walls 68 are provided at the upper side of the supply holes 50A formed in the piezoelectric element substrate 50. The configuration of the rib dividing walls 68 is also the same as that of the first embodiment. Spaces 61 are formed between the 50 and 71 due to these rib dividing walls 68.

With the inkjet recording head 34 configured as described above, the pressure chambers 86 are formed at the bottom side of the piezoelectric element substrate 50, and the ink pool chamber 94 is formed on the upper side of the second upper substrate 71, so these are configured such that both groups do not exist on the same horizontal plane. Accordingly, it becomes possible to arrange the pressure chambers 86 in a state where they are in close proximity with each other, and the nozzles 84 can be arranged with high density in a matrix pattern.

Moreover, the ink pool chamber 94 is wide and there is little dead water region so bubbles can be adequately removed.

Further, the wiring from the individual piezoelectric elements 54 is lifted up to the second upper substrate 71 side due to the bumps 78 so the metal wiring 74 can be formed on the second upper substrate 71 its surface is flat. When compared to when metal wiring is formed on the piezoelectric element substrate 50, the wiring can be easily formed (this is due to the fact that if it is on the side of the piezoelectric element substrate 50, it is necessary to form wiring that has a step due to the piezoelectric element 54).

Furthermore, thin film transistors 75 are formed on the second upper substrate 71, so the large sized drive IC and bumps for connecting the drive IC to the second upper substrate 71 necessary when mounting the drive IC on the piezoelectric element substrate 50 become unnecessary, so the inkjet recording head 34 can be made more compact.

Further, the thin film transistor 75, which becomes a heat source, is mounted on the second upper substrate 71 so, when compared to when it is mounted on the piezoelectric element substrate 50, increases in the temperature of the ink within the pressure chamber 86 can be suppressed. Due to this, ink droplet volume variations due to ink temperature irregularities inside the pressure chamber 86 can be suppressed.

Further, with the inkjet recording head 34 configured as described above, the spaces 61 are formed by the rib dividing walls 68 so, when compared to when no spaces 61 are formed (i.e., when ink is filled in the hollow portions), different types of interfaces that contact the ink can be lessened and the selections of the interior processing can be increased (e.g., Au sputtering can be utilized).

Furthermore, since the spaces 61 are formed, the ink can be easily separated from the piezoelectric elements 54, thus preventing inhibition of the deformation of the diaphragm 52.

Next, the manufacturing process of the inkjet recording head 34 configured as described above will be explained in detail based on FIGS. 18 through 21.

Figure 18:
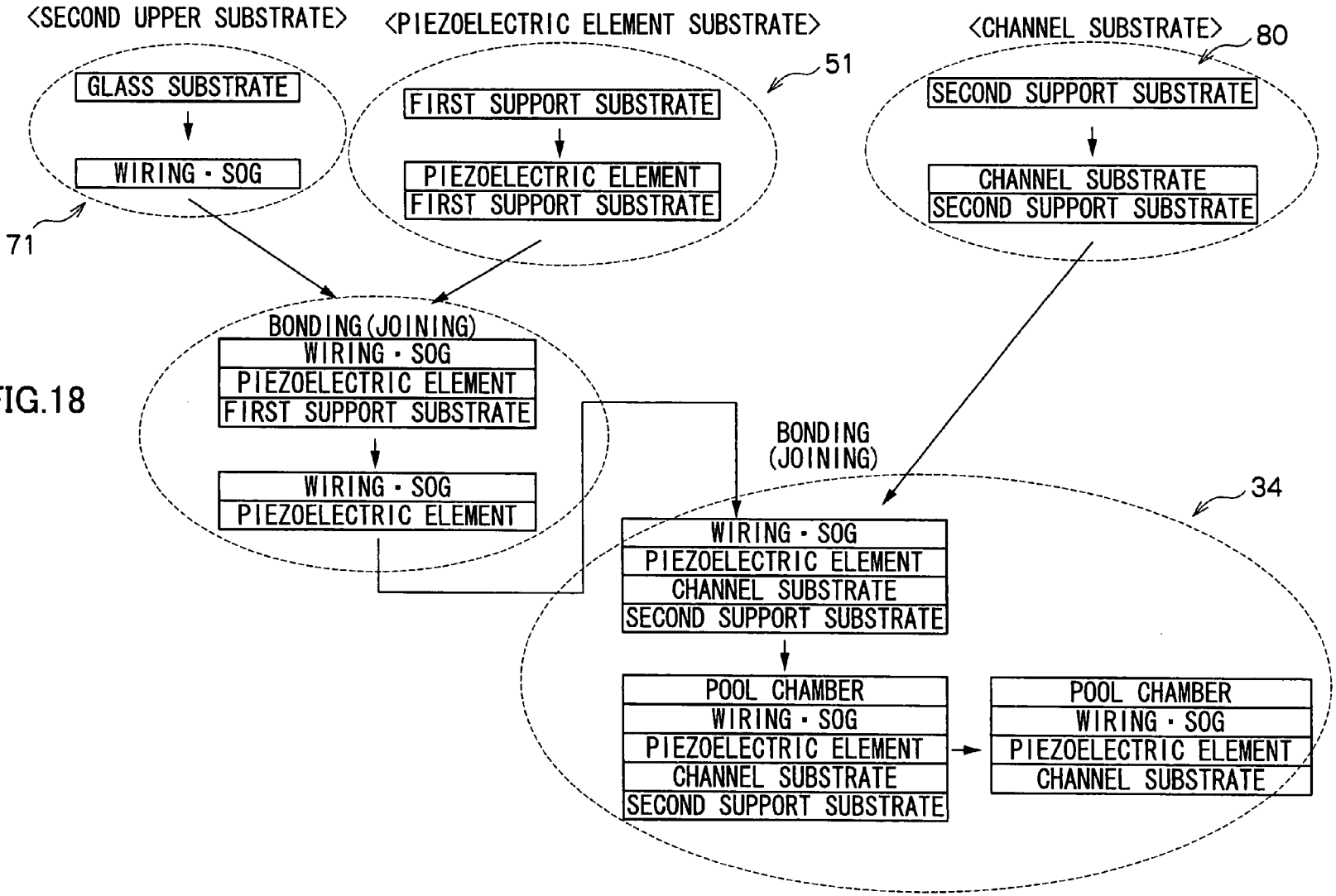
FIG. 18 is an explanatory diagram of the entire process of manufacturing the inkjet recording head of the second embodiment.

As shown in FIG. 18, this inkjet recording head 34 is manufactured by making each of the second upper substrate 71, piezoelectric element substrate 50, and channel substrate 80 separately and by attaching (i.e., joining) these. The manufacturing processes for the piezoelectric element substrate 50 and channel substrate 80 are the same as in the first embodiment so detailed explanations thereon have been omitted, and the manufacturing process of the second upper substrate 71 will be explained.

Figures 19A, 19B, 19C, 19D, 19E:
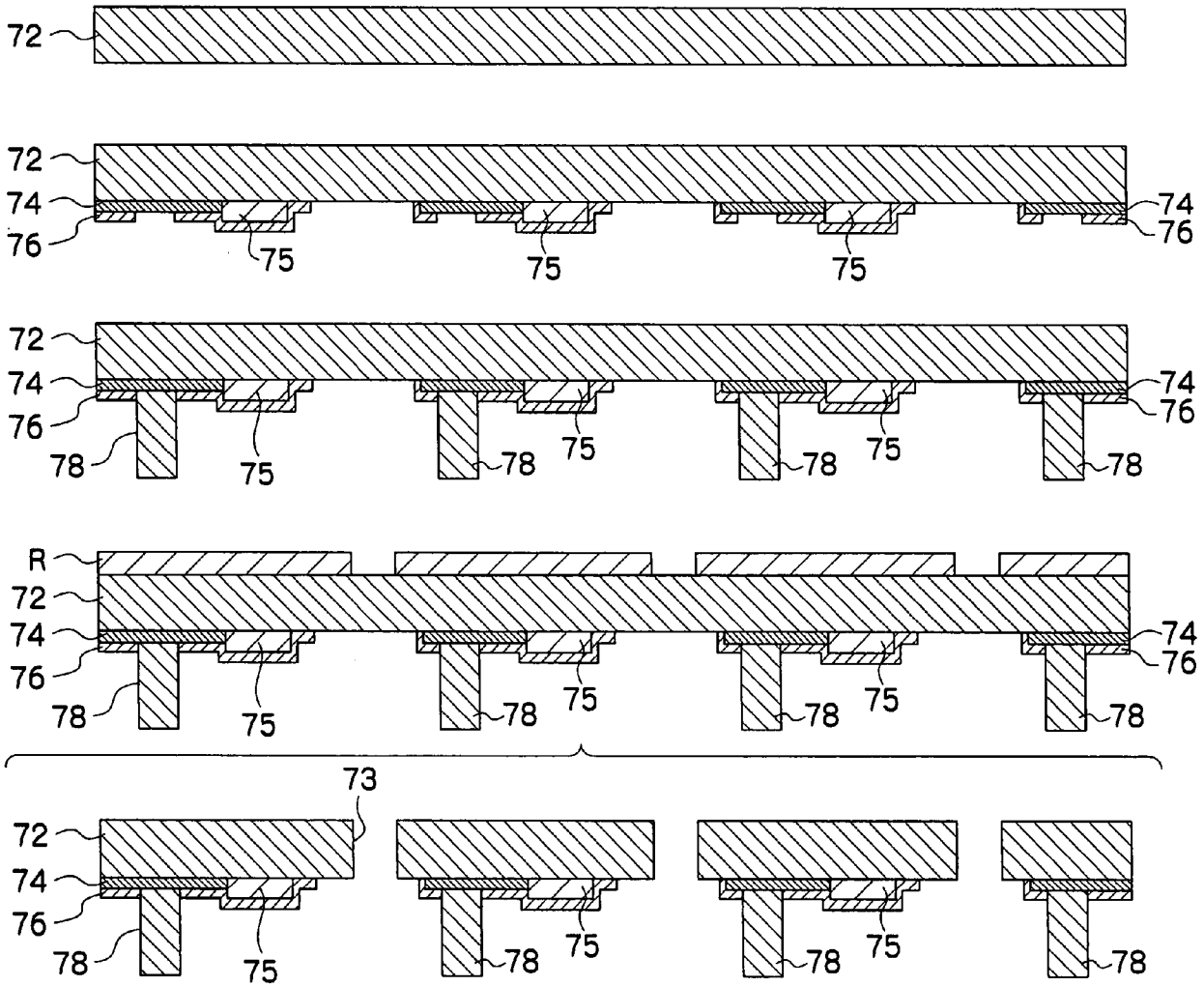
FIG. 19A-19E are explanatory diagrams showing the processes of manufacturing a second upper substrate.

As shown in FIG. 19A, first a glass substrate 72 is prepared. This is not limited to being made of glass, as long as the glass substrate 72 does not flex and is thick enough to act as a support, however, glass is preferable in that it is both hard and cost-effective. Notably, in the manufacturing of this second upper substrate 71, the glass substrate 72 is thick enough in itself to ensure the degree of strength necessary to serve as a support (0.3 mm to 1.5 mm), so it is unnecessary to provide a separate support.

Next, as shown in FIG. 19B, a metal layer is layered on the bottom surface of the glass substrate 72, and the metal wiring 74 is patterned. Specifically, processing is performed where an A1 layer (with a thickness of 1 μm) is coated with a sputtering method, a resist is formed with a photolithographic method, the A1 layer is etched with an RIE method using a chlorine-based gas, and the resist layer is removed with oxygen plasma.

Further, thin film transistors 75 are formed on the facing surface 72A that is the surface on which the metal wiring 74 is formed. The thin film transistors 75 are generally formed with a low-temperature Poly Si TFT process.

Next, a resin layer 76 is formed on the metal wiring 74 and the thin film transistor 75. Notably, the resin layer 76 is made so as to not be layered on the portions joining the upper electrode 58 to the connecting bumps 78. Specifically, a photosensitive resin having resistance to ink and flexibility, for example, a photosensitive resin layer of polyimide, polyamide, epoxy, polyurethane, or silicon and the like, is layered as the resin layer 76, and patterned by exposure and developing (e.g., the photosensitive polyimide Durimide 7320 made by FUJIFILM Arch Co., Ltd.).

Then as shown in FIG. 19C, bumps 78 connecting to the metal wiring 74 are formed. Processes such as electrical plating, non-electrical plating, ball bump processing, screen printing and the like can be applied to the formation of the bumps 78. The bumps 78 are made to be taller than the rib dividing walls 68 in order to make joining with the upper electrode 58 at the time of joining with the piezoelectric element substrate 50 easier.

Next, through-holes 73 that allow ink to pass through are formed in the glass substrate 72. With regard to the formation of the through-holes 73, firstly, as shown in FIG. 19D, the resist on the upper surface of the glass substrate 72 is patterned. Next, holes are opened with sandblasting and resist peeling performed, whereby, as shown in FIG. 19E, the through-holes 73 are formed.

The second upper substrate 71 is thus manufactured in this manner.

Next, the process for bonding (i.e., joining) the piezoelectric element substrate 50 and the second upper substrate 71 will be explained.

Figure 20A:
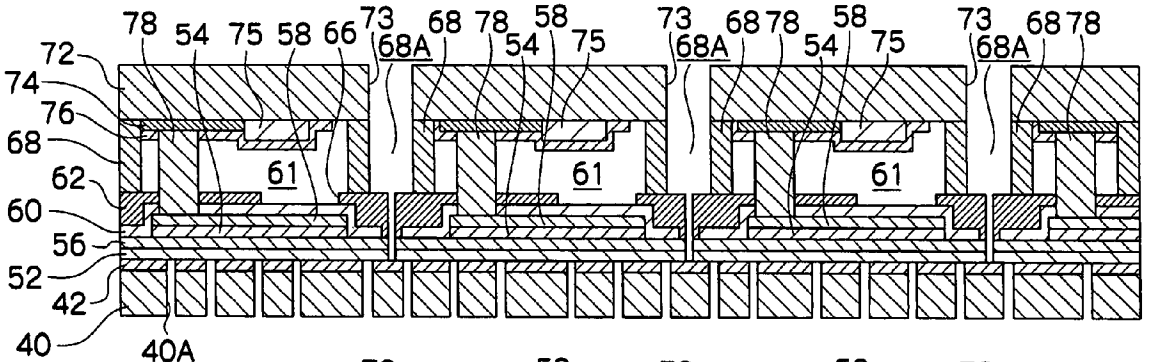
FIG. 20A-20C are explanatory diagrams showing the processes of joining the piezoelectric element substrate and the second upper substrate.

As shown in FIG. 20A, the side of the piezoelectric element substrate 50 and rib dividing walls 68 is made to face the side on which the second upper substrate 71 and bumps 78 are formed, and these are both connected (i.e., bonded together) with thermocompression. That is, the rib dividing walls 68 are bonded to the glass substrate 72 and resin layer 76, and the bumps 78 to the upper electrode 58.

At this time, the bumps 78 are taller than the rib dividing walls 68 so by joining the rib dividing walls 68 to the glass substrate 72 and resin layer 76, the bumps 78 are automatically joined to the upper electrode 58. Stated differently, height adjustment of the bumps 78 is simple (i.e., they are easily deformed) so forming the supply routes 68A and spaces 61 with the rib dividing walls 68 and connecting to the bumps 78 can be performed easily.

Figure 20B:
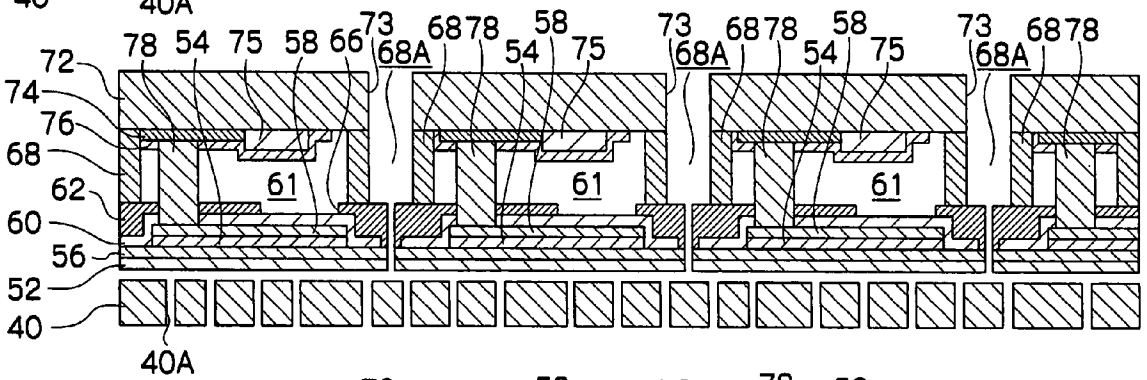
Figure 20C:
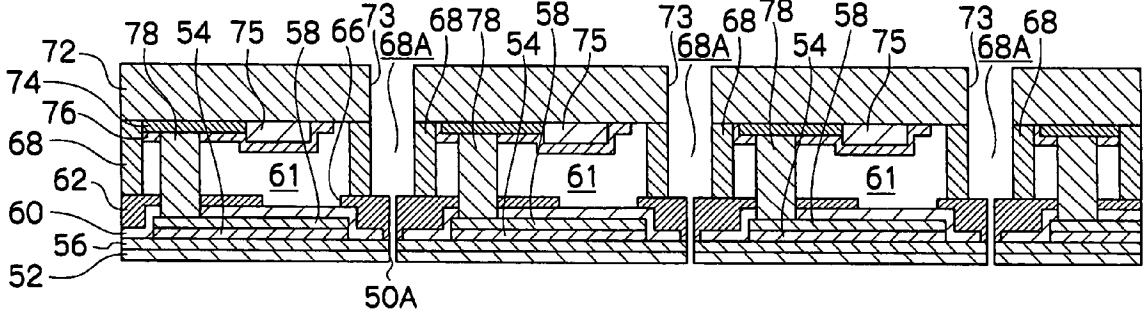

Next, as shown in FIG. 20B, a removable adhesive solution (e.g., an organic ethanol amine solvent) is injected from the through-holes 40A of the first support substrate 40, and removing processing of the first support substrate 40 from the piezoelectric element substrate 50 is performed by selectively dissolving the resin adhesive 42. Due to this, as shown in FIG. 20C, the joined substrate of the second upper substrate 71 and piezoelectric element substrate 50 is completed.

Next, the bonding (i.e., joining) of the channel substrate to the joined bodies of the piezoelectric element substrate 50 and the second upper substrate 71 will be explained.

Figure 21A:
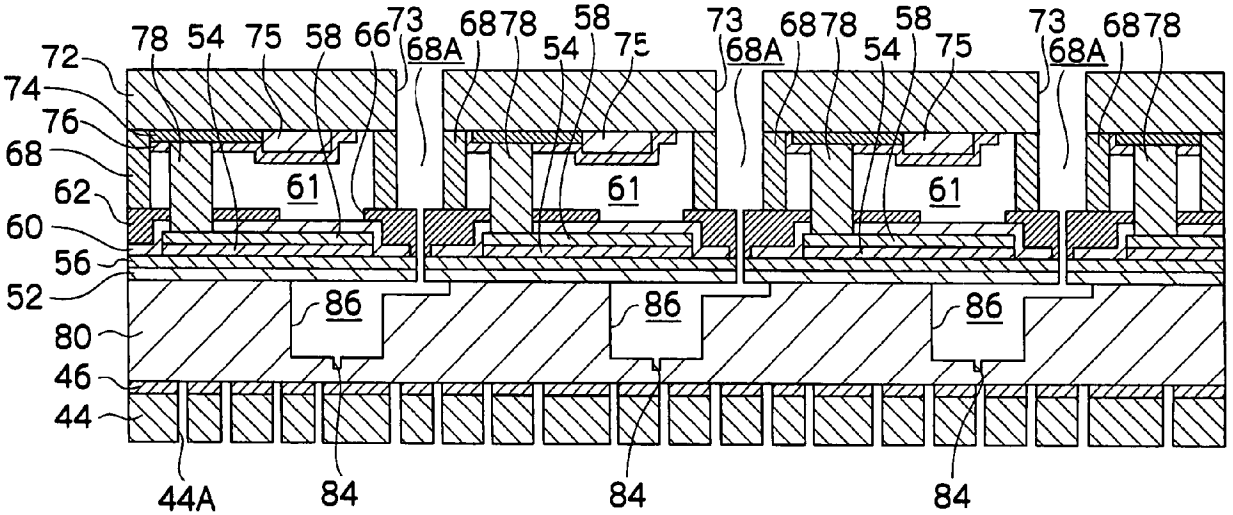
FIG. 21A-21F are explanatory diagrams showing the processes of joining the channel substrate to the joined bodies of the piezoelectric element substrate and the second upper substrate.
Figure 21B:
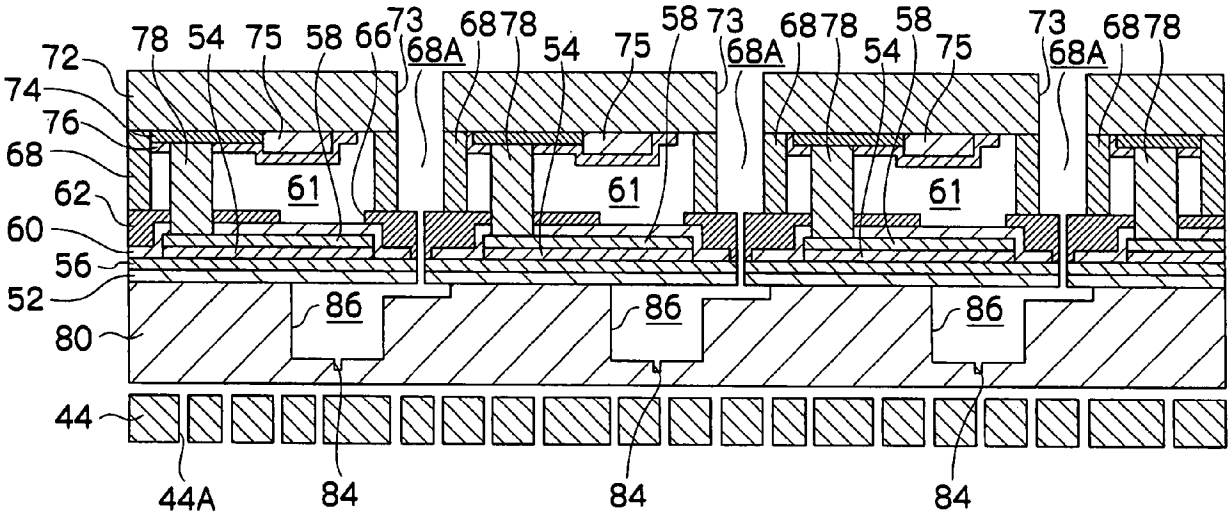

As shown in FIG. 21A, the side of the diaphragm 52 of the piezoelectric element substrate 50 and the side on which the pressure chambers 86 of the channel substrate 80 are formed are connected (i.e., bonded together) with thermocompression. Then as shown in FIG. 21B, a removable adhesive solution (e.g., an organic ethanol amine solvent) is injected from the through-holes 44A of the second support substrate 71, and separating processing of the second support substrate 44 from the channel substrate 80 is performed by selectively dissolving the resin adhesive 46.

Figure 21C:
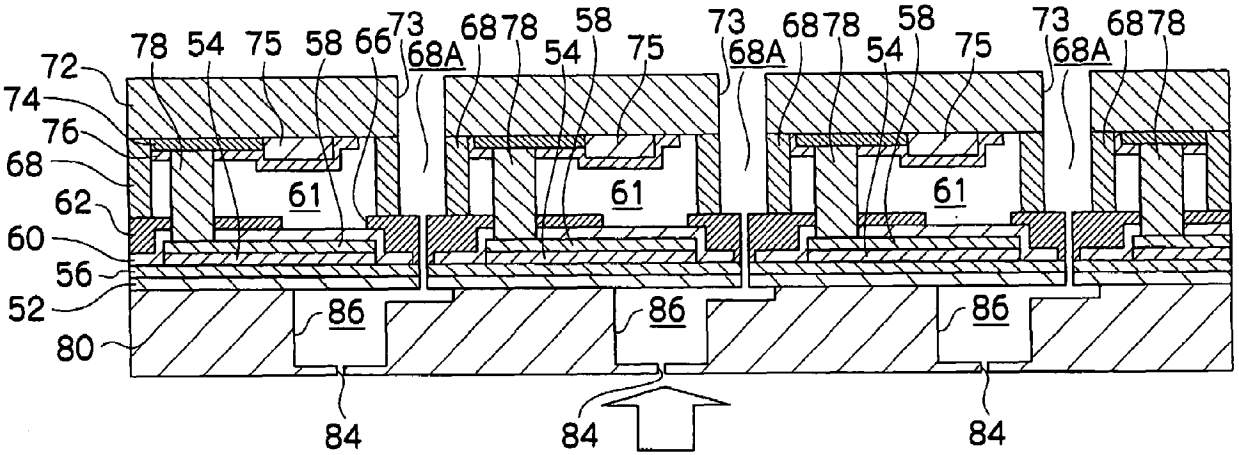
Figure 21D:
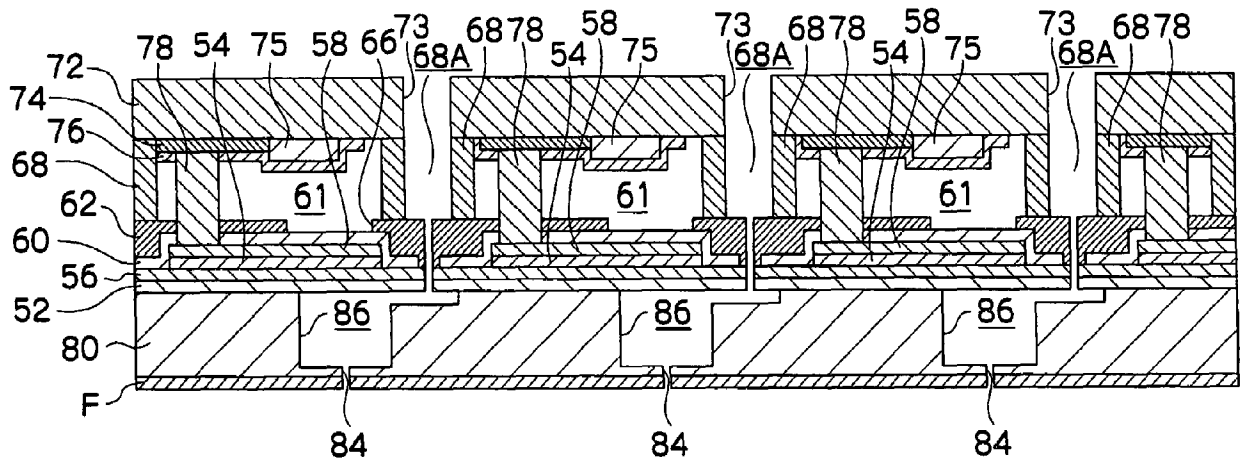

After that, as shown in FIG. 21C, a surface layer of the surface from which the second support substrate 71 was removed is removed with grinding processing using a grinding material having alumina as its principal component, or with RIE processing using oxygen plasma, whereby the nozzles 84 are opened. Then, as shown in FIG. 21D, a fluorine material F (e.g., Cytop produced by the Asahi Glass Co., Ltd.) is coated as a water repellent on the bottom surface where the nozzles 84 were opened.

Figure 21E:
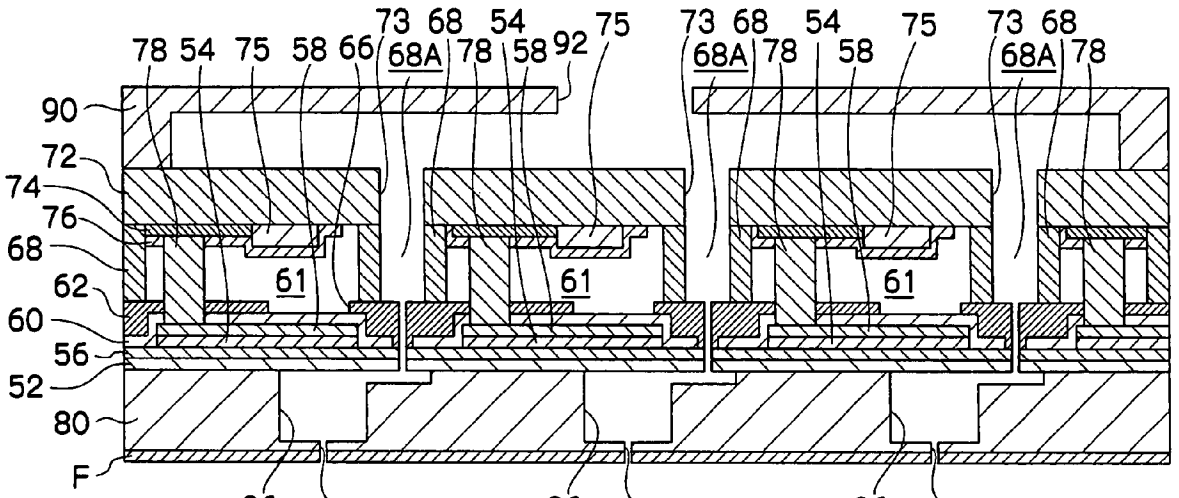
Figure 21F:
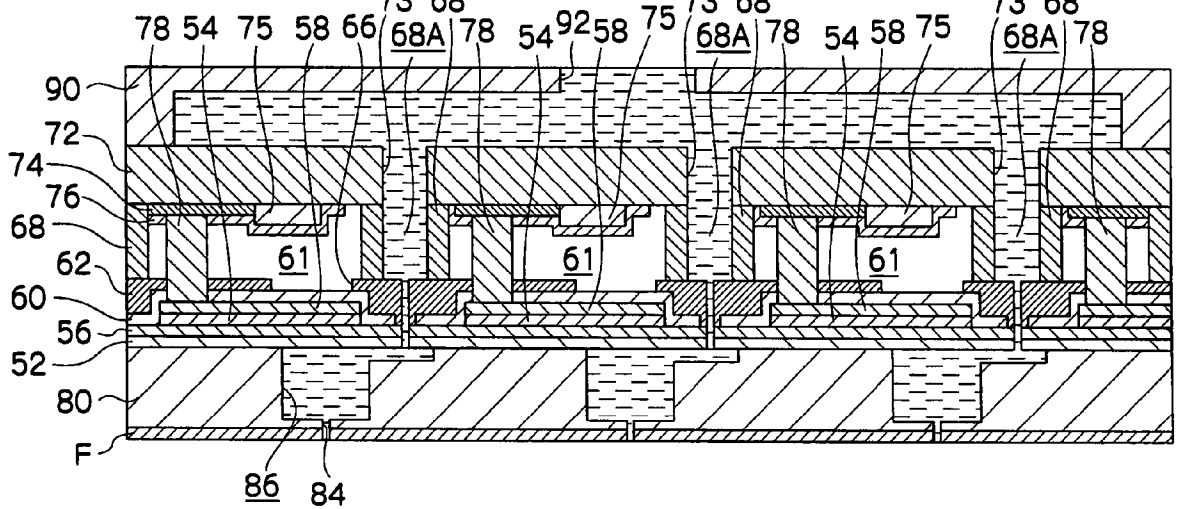

Next, as shown in FIG. 21E, by joining the ink pool component 90 to the upper surface of the second upper substrate 71, the inkjet recording head 34 is completed and ink can be filled inside the ink pool chamber 94 and the pressure chamber 86.

Figure 22:
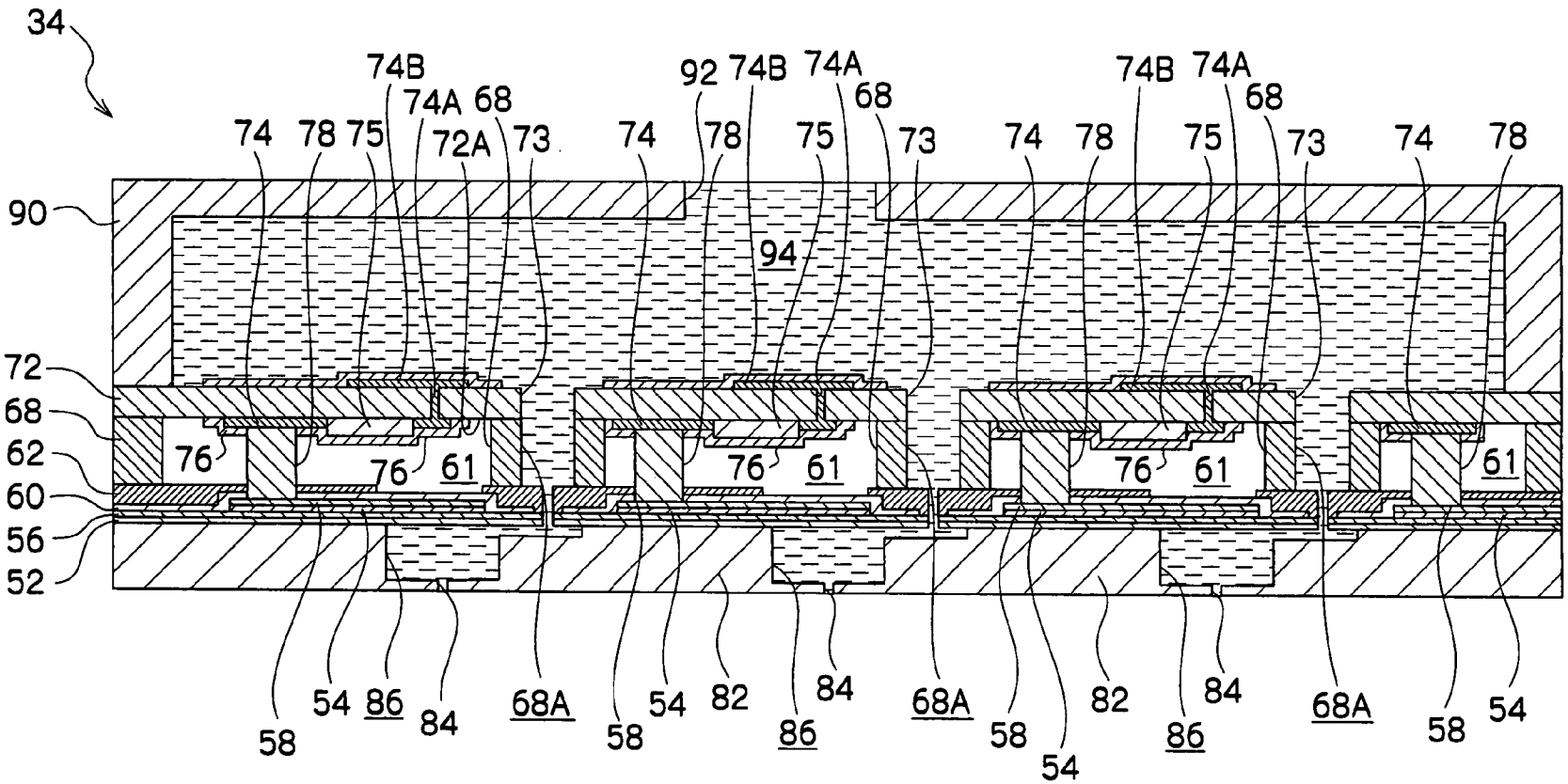
FIG. 22 is a schematic diagram showing the structure of an alternate example of the inkjet recording head of the second embodiment.

It should be noted that in the above-described embodiment, the metal wiring 74 was provided on the bottom surface of the glass substrate 72 only, however, as shown in FIG. 22, through wiring 74A connected to the metal wiring 74 and upper surface wiring 74B provided on the upper surface side of the glass substrate 72 and connected with the through wiring 74A can be formed at the glass substrate 72 (i.e., where the upper surface wiring 74B is covered with a resin layer 76B). In this manner, by forming the upper surface wiring 74B, the wiring area can be expanded without changing the size of the inkjet recording head 34. The upper surface wiring 74B can also be used for other things, such as input signal wiring. Since the upper surface wiring 74B is arranged at the exterior side of the inkjet recording head 34, it can easily be connected to other components such as a control board (not shown).

Figure 23:
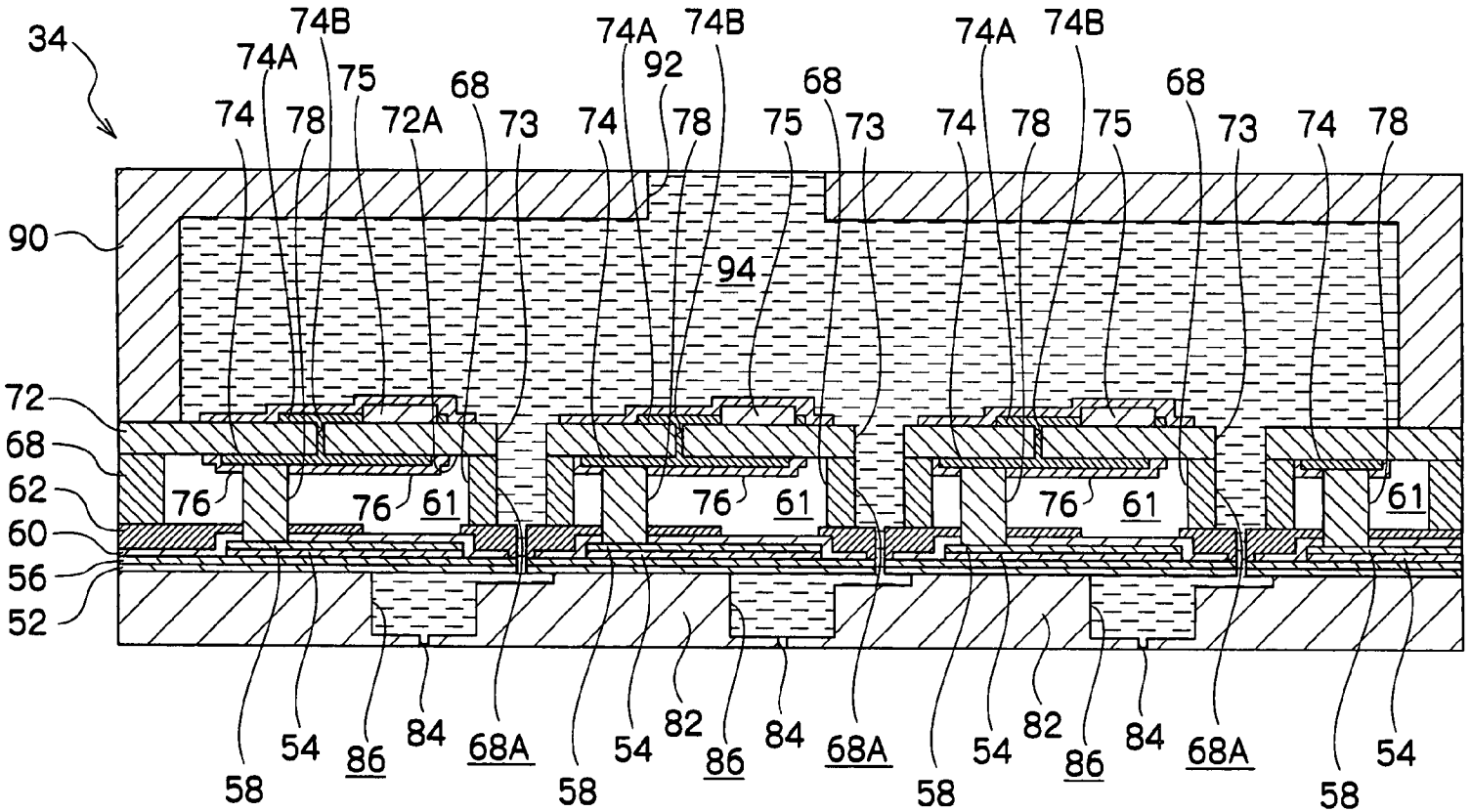
FIG. 23 is a schematic diagram showing the structure of another alternate example of the inkjet recording head of the second embodiment.
Figure 24:
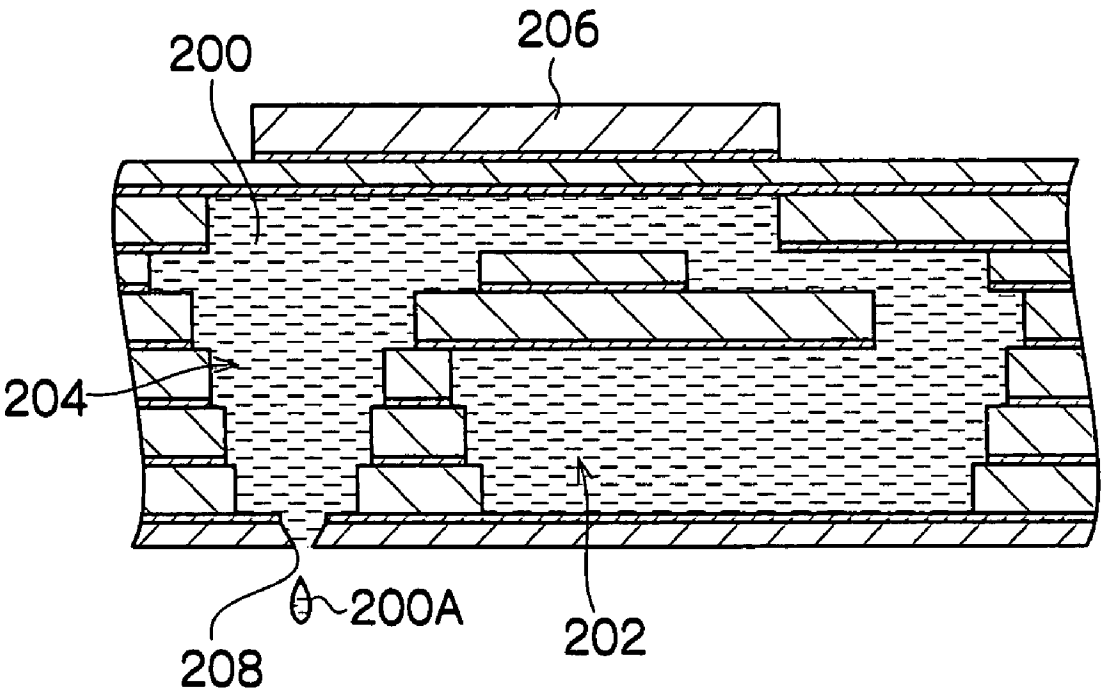
FIG.24 RELATED ART
FIG. 24 is a schematic cross-sectional diagram showing the structure of a conventional inkjet recording head.
Figure 25:
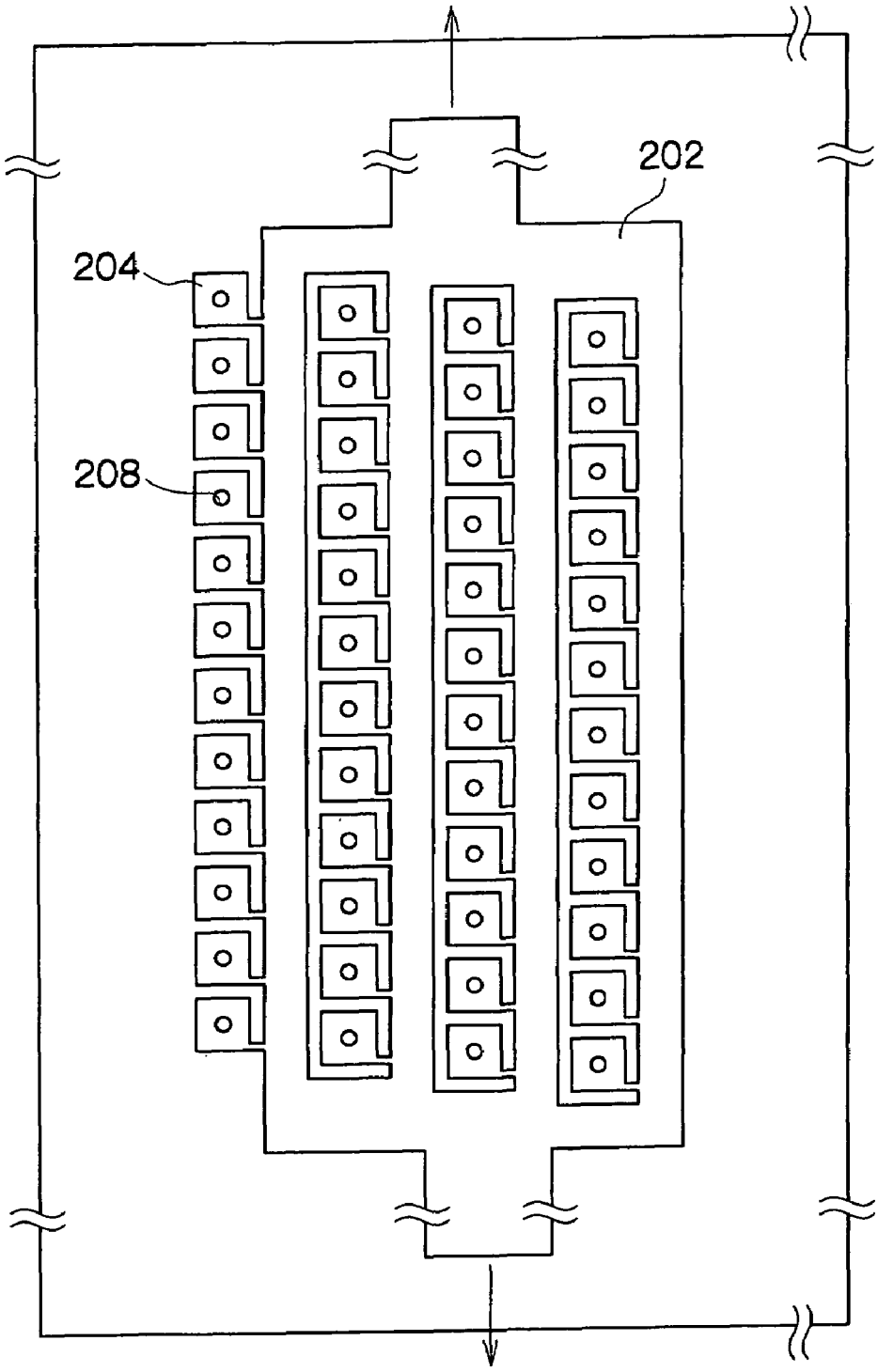
FIG.25 RELATED ART
FIG. 25 is a schematic planar diagram showing the structure of a conventional inkjet recording head.
Figure 26A:
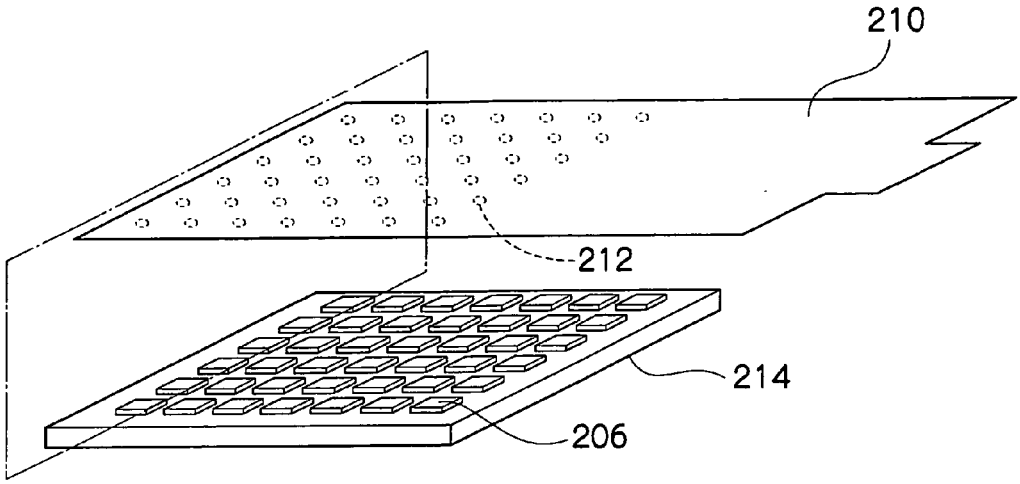
FIG.26A RELATED ART
FIGS. 26A and 26B are schematic inclined diagrams showing the structure of a conventional inkjet recording head.
Figure 26B:
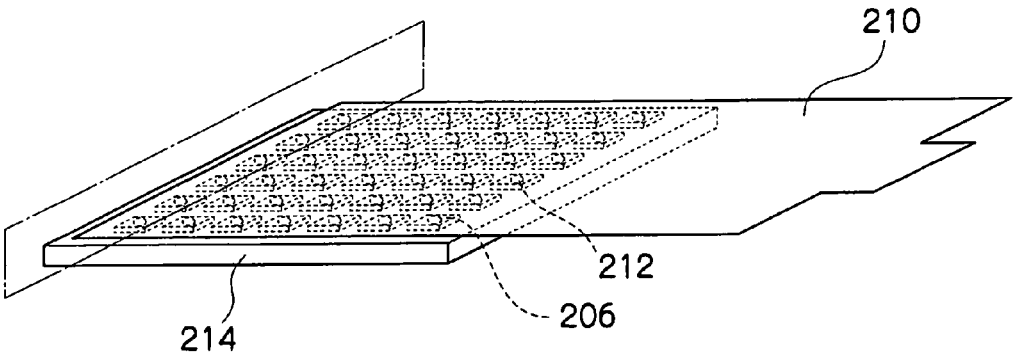
FIG.26B RELATED ART

Further, in the above-described embodiment, the thin film transistor 75 was formed at the bottom surface side of the second upper substrate 71, however, as shown in FIG. 23, the thin film transistor 75 can be formed at the upper surface side at the ink pool chamber 94 of the second upper substrate 71. By setting the thin film transistor 75 inside the ink pool chamber 94, the thin film transistor 75 generating heat is cooled by the ink so heat-dissipating qualities can be improved (i.e., due to a water-cooling effect).

The operation of the inkjet recording head 34 set in the inkjet recording device 100 is the same as that of the first embodiment, so detailed explanations thereon have been omitted.

It should be noted that with the present embodiment, an example was explained of an FWA of paper width correspondence, however, the inkjet recording head of the present invention is not limited thereto, and can also be applied to PWA devices.

Further, the recording medium is not limited to paper and the ejected liquid is not limited to ink. The inkjet recording head 34 of the present invention can be applied to, for example, general liquid-ejecting (i.e., spraying) devices used industrially, such as those used when ejecting ink onto polymer films and glass when making color filters for displays, or for when ejecting solder in a molten state on a substrate when forming bumps for mounting parts.

As explained above, the liquid droplet ejecting device of the present invention comprises: a nozzle that ejects liquid droplets; a pressure chamber communicated with the nozzle and into which a liquid is filled; a piezoelectric element substrate having an diaphragm that forms a part of the pressure chamber and a piezoelectric element that displaces the diaphragm; a liquid pool chamber that is disposed opposite from the pressure chamber with the piezoelectric element substrate being disposed therebetween and which pools liquid supplied to the pressure chamber; an upper substrate disposed the liquid pool chamber and the piezoelectric element substrate so as to be separated from and face the piezoelectric element substrate with a through port for supplying liquid to the pressure chamber from the liquid pool chamber formed therein; a driver that is mounted on the upper substrate and which drives the piezoelectric element; and a connecting component arranged between the upper substrate and the piezoelectric element substrate and which electrically connects the piezoelectric element to the upper substrate.

Accordingly, due to the present invention, the liquid pool chamber is disposed opposite from the pressure chamber with the piezoelectric element substrate being disposed therebetween, so the pressure chambers can be set adjacent to each other and the nozzles set at each pressure chamber can be arranged in a highly dense formation.

Further, by diposing the connecting components between the facing piezoelectric element and the upper substrate and electrically connecting them, the driver that drives the piezoelectric element can be mounted on the upper substrate. Accordingly, wiring for the driver and the piezoelectric element can be provided on the upper substrate thus making the wiring simpler. That is, it is not necessary to have the wiring formed on bumps on the substrate, such as is the case when the driver is provided on the piezoelectric element substrate.

Further, the driver, which can become a source of heat, is mounted on the upper substrate so increases in temperature of the liquid in the pressure chambers can be better suppressed than when it is mounted on the piezoelectric element substrate.

Further, the piezoelectric element is electrically connected to the upper substrate that faces each of the connecting components, so the driver is mounted on the piezoelectric element substrate and a large connecting component for connecting the wiring to the upper substrate at the regions where the piezoelectric element of the piezoelectric element substrate is not arranged becomes unnecessary, whereby the liquid droplet ejecting device can be made more compact.

Further, with the liquid droplet ejecting device of the present invention, the upper substrate is arranged between the liquid pool chamber and the piezoelectric element substrate. For this reason, liquid can be easily kept away from the piezoelectric element without forming a dividing layer due to the upper substrate. Furthermore, liquid can be easily supplied to each pressure chamber by the formation of through ports in the upper substrate.

Further, the liquid droplet ejecting device of the present invention can be characterized in that the upper substrate is provided with through wiring that passes through a facing surface, of the upper substrate, at a side thereof that faces the piezoelectric element substrate and a rear surface of the rear side of the facing surface, and with rear surface wiring arranged on the rear surface and connected to the through wiring.

Due to the above-described configuration, wiring can also be placed on the rear surface side of the upper substrate and can be connected to the piezoelectric element with through-wiring.

Further, the liquid droplet ejecting device of the present invention can be characterized in that the driver is mounted on the rear surface.

With the above-described configuration, the driver is not arranged between the upper substrate and the piezoelectric element substrate so this can be easily mounted after the upper substrate and the piezoelectric element substrate are joined.

The liquid droplet ejecting device of the present invention can be characterized in that the driver is arranged within the liquid pool chamber.

By arranging the driver, which can become a source of heat, inside the liquid pool chamber in this manner, the driver can be cooled with the liquid in the liquid pool chamber so the adverse affects to each of the substrates due to the generation of heat by the driver can be controlled.

The liquid droplet ejecting device of the present invention can be characterized in that the driver is mounted on a facing surface of the upper substrate.

Due the above configuration, the driver can be mounted with a simple configuration without providing through-wiring on the upper substrate.

Further, since a device that acts as a driver such as an IC does not have to be mounted on the rear surface of the upper substrate (i.e., the surface on the side of the liquid pool chamber), it is not necessary to provide a space that joins the dividing wall of the liquid pool chamber, so the liquid droplet ejecting device can be made to be more compact.

It should be noted that the driver of the liquid droplet ejecting device of the present invention can be configured to include the integrated circuits or thin film transistor.

The liquid droplet ejecting device of the present invention can be characterized in that one through port is formed per piezoelectric element.

Due to the above-described configuration, each of the individual pressure chambers can be made more resistant to the adverse affects of the oscillations of other pressure chambers.

The liquid droplet ejecting device of the present invention can be characterized in that the liquid droplet ejecting device is further comprising with a rib dividing wall between the upper substrate and the piezoelectric element substrate, wherein the rib dividing wall forms a liquid supply route that is communicated with the through port and supplies liquid to the pressure chamber and also forms a space between the upper substrate and the piezoelectric element substrate.

Due to the above configuration, the rib dividing walls form the liquid supply route communicated with the through-holes and form the space between the upper substrate and the piezoelectric element substrate. Accordingly, liquid can be supplied to the pressure chambers and spaces can be formed so that the deformation of the diaphragm is not inhibited, all with a simple structure. Further, liquid can be easily kept away from the piezoelectric elements.

It should be noted that it is preferable that the spaces be communicated with the outside air. By making the spaces communicated with the outside air, changes in air pressure that occur within the spaces when they are sealed can be prevented.

The liquid droplet ejecting device of the present invention can be characterized in that the nozzles are arranged in a matrix pattern.

By arranging the nozzles in a matrix pattern in this manner, high-resolution images can be recorded.

The liquid droplet ejecting device of the present invention is provided with the above liquid droplet ejecting device.

Further, due to the liquid droplet ejecting device of the present invention, the nozzles are set in a highly dense arrangement so high-resolution images can be recorded. Further, since the head can be made to be compact, the device can also be made compact.

As explained above, the present invention was made to provide a liquid droplet ejecting device that can realize a dense arrangement of nozzles and the formation of minute pitch wiring that accompanies it in order to achieve high resolution. The present invention also provides a compact liquid droplet ejecting device and a liquid droplet ejecting device comprising this liquid droplet ejecting device.

What is claimed is:

1. A liquid droplet ejecting head comprising:

a nozzle that ejects liquid droplets;

a pressure chamber communicated with the nozzle and into which a liquid is filled;

a piezoelectric element substrate having a diaphragm that forms a part of the pressure chamber and a piezoelectric element that displaces the diaphragm;

a liquid pool chamber that is disposed opposite from the pressure chamber with the piezoelectric element substrate being disposed therebetween and which pools liquid supplied to the pressure chamber;

an upper substrate disposed the liquid pool chamber and the piezoelectric element substrate so as to be separated from and face the piezoelectric element substrate with a through port for supplying liquid to the pressure chamber from the liquid pool chamber formed therein;

a driver that is mounted on the upper substrate and which drives the piezoelectric element; and a connecting component arranged between the upper substrate and the piezoelectric element substrate and which electrically connects the piezoelectric element to the upper substrate.

2. The liquid droplet ejecting head of claim 1, wherein the upper substrate is provided with through wiring that passes through a facing surface, of the upper substrate, at a side thereof that faces the piezoelectric element substrate and a rear surface of the rear side of the facing surface, and with rear surface wiring arranged on the rear surface and connected to the through wiring.

3. The liquid droplet ejecting head of claim 2, wherein the driver is mounted on the rear surface.

4. The liquid droplet ejecting head of claim 3, wherein the driver is arranged within the liquid pool chamber.

5. The liquid droplet ejecting head of claim 2, wherein the driver is mounted on the facing surface of the upper substrate.

6. The liquid droplet ejecting head of claim 3, wherein the driver comprises an integrated circuit.

7. The liquid droplet ejecting head of claim 3, wherein the driver comprises a thin film transistor.

8. The liquid droplet ejecting head of claim 3, further comprising with a rib dividing wall between the upper substrate and the piezoelectric element substrate, wherein the rib dividing wall forms a liquid supply route that is communicated with the through port and supplies liquid to the pressure chamber and also forms a space between the upper substrate and the piezoelectric element substrate.

9. The liquid droplet ejecting head of claim 1, wherein the driver is mounted on a facing surface of the upper substrate.

10. The liquid droplet ejecting head of claim 9, wherein the driver comprises an integrated circuit.

11. The liquid droplet ejecting head of claim 9, wherein the driver comprises a thin film transistor.

12. The liquid droplet ejecting head of claim 9, further comprising with a rib dividing wall between the upper substrate and the piezoelectric element substrate, wherein the rib dividing wall forms a liquid supply route that is communicated with the through port and supplies liquid to the pressure chamber and also forms a space between the upper substrate and the piezoelectric element substrate.

13. The liquid droplet ejecting head of claim 1, wherein the driver comprises an integrated circuit.

14. The liquid droplet ejecting head of claim 1, wherein the driver comprises a thin film transistor.

15. The liquid droplet ejecting head of claim 1, wherein one through port is formed per piezoelectric element.

16. The liquid droplet ejecting head of claim 1, further comprising with a rib dividing wall between the upper substrate and the piezoelectric element substrate, wherein the rib dividing wall forms a liquid supply route that is communicated with the through port and supplies liquid to the pressure chamber and also forms a space between the upper substrate and the piezoelectric element substrate.

17. The liquid droplet ejecting head of claim 16, wherein the space is communicated with the outside air.

18. The liquid droplet ejecting head of claim 1, wherein the nozzles are arranged in a matrix pattern.

19. A liquid droplet ejecting device having a liquid droplet ejecting head comprising:

a nozzle that ejects liquid droplets;

a pressure chamber communicated with the nozzle and into which a liquid is filled;

a piezoelectric element substrate having an diaphragm that forms a part of the pressure chamber and a piezoelectric element that displaces the diaphragm;

a liquid pool chamber that is disposed opposite from the pressure chamber with the piezoelectric element substrate being disposed therebetween and which pools liquid supplied to the pressure chamber;

an upper substrate disposed the liquid pool chamber and the piezoelectric element substrate so as to be separated from and face the piezoelectric element substrate with a through port for supplying liquid to the pressure chamber from the liquid pool chamber formed therein;

a driver that is mounted on the upper substrate and which drives the piezoelectric element; and a connecting component arranged between the upper substrate and the piezoelectric element substrate and which electrically connects the piezoelectric element to the upper substrate.

* * * * *